US008123316B2

(12) United States Patent
Shimoda et al.

(10) Patent No.: US 8,123,316 B2
(45) Date of Patent: Feb. 28, 2012

(54) INKJET IMAGE-FORMING APPARATUS AND METHOD FOR PRINTING

(75) Inventors: Tomohiko Shimoda, Ibaraki-ken (JP); Yukihiro Maeda, Ibaraki-ken (JP); Kenji Oshima, Ibaraki-ken (JP)

(73) Assignee: Riso Kagagu Corporation, Tokyo (JP)

( * ) Notice: Subject to any disclaimer, the term of this patent is extended or adjusted under 35 U.S.C. 154(b) by 344 days.

(21) Appl. No.: 12/588,110

(22) Filed: Oct. 5, 2009

(65) Prior Publication Data

US 2010/0085395 A1 Apr. 8, 2010

(30) Foreign Application Priority Data

Oct. 8, 2008 (JP) ..... P2008-262129
Oct. 8, 2008 (JP) ..... P2008-262147

(51) Int. Cl.
*B41J 29/38* (2006.01)

(52) U.S. Cl. ..... 347/6

(58) Field of Classification Search ..... 347/5, 6, 347/9, 10, 17
See application file for complete search history.

(56) References Cited

U.S. PATENT DOCUMENTS 7,438,376 B2 * 10/2008 Tamura et al. ..... 347/17
8,038,249 B2 * 10/2011 Hayashi et al. ..... 347/17

FOREIGN PATENT DOCUMENTS

JP 2007-296754 A 11/2007

* cited by examiner

*Primary Examiner* — An Do
(74) *Attorney, Agent, or Firm* — The Nath Law Group; Jerald L. Meyer; Derek Richmond

(57) ABSTRACT

An image forming apparatus including: a print-job controller configured to receive a print job and control a printing operation based on the received print job; an ink-ejection driver configured to output a driving signal on the basis of the print job; an ink ejector configured to eject ink onto a paper sheet on the basis of the driving signal outputted by the ink-ejection driver; and an ink-temperature measuring unit configured to measure an ink temperature. When the ink temperature measured by the ink-temperature measuring unit is equal to or higher than a first reference temperature, the ink-ejection driver outputs a driving signal of a first voltage. When the ink temperature measured by the ink-temperature measuring unit is lower than the first reference temperature and is equal to or higher than a second reference temperature that is lower than the first reference temperature, the print-job controller performs the printing operation as long as predetermined conditions are satisfied for suppressing lowering of print quality possibly caused by ink ejection based on a driving signal of a second voltage that is higher than the first voltage and the ink-ejection driver outputs the driving signal of the second voltage while the printing operation is being performed.

15 Claims, 24 Drawing Sheets

INKJET IMAGE-FORMING APPARATUS AND METHOD FOR PRINTING

CROSS REFERENCE TO RELATED APPLICATION

This application is based upon and claims the benefit of priority from the prior Japanese Patent Application Nos. 2008-262129 and 2008-262147, filed on Oct. 8, 2008, the entire contents of which are incorporated herein by reference.

BACKGROUND OF THE INVENTION

1. Field of the Invention

The invention relates to an inkjet image-forming apparatus and a printing method, and specifically, to an image-forming apparatus and a printing method which are capable of reducing both the mist production and the influence caused by the produced mist as well as capable of reducing time to start a printing operation under a low-temperature environment.

2. Description of the Related Art

Inkjet printers, which have been widely used, form images by ejecting ink onto a printing sheet from printing heads. Printing heads in inkjet printers eject ink by applying a driving voltage to an ink-ejection mechanism such as a piezoelectric element. The ink used in inkjet printers typically has characteristics that the ink increases its viscosity under a low-temperature environment. Therefore, the amount of ink to be ejected is not enough under the application of the driving voltage that is applied in ordinary occasions (hereafter, simply referred to as the "ordinary driving voltage"). Accordingly, under a low-temperature environment, heaters are used to warm the ink and printing is started only after the ink is warmed up to an appropriate temperature. For this reason, a problem arises that a print-start time delays when the inkjet printer is used under a low-temperature environment. The problem becomes more noticeable in the case of ink-circulation type inkjet printers each equipped with an ink-circulation route, because the ink-circulation type inkjet printer has a larger amount of ink to be heated.

The inkjet printer disclosed in Japanese Patent Application Publication No. 2007-296754 has not only a problem that the print-start time delays due to the increased viscosity of ink under a low-temperature environment, but also a problem that mist, which is unnecessary microscopic ink droplets produced when the ink is ejected, attaches to the printing sheet or the inside of the printer chassis, resulting in a lower-quality print.

SUMMARY OF THE INVENTION

In order to start printing earlier under a low-temperature environment, conceivable way is to apply a larger driving voltage to the ink-ejection mechanism and thus to cause the ink-ejection mechanism to eject an appropriate amount of the ink. The application of a larger driving voltage, however, accelerates the ink-ejection speed, resulting in an increase in the mist production. Increased mist production in turn increases the mist attaching to the inside of the printer chassis. The mist flying about and the mist accumulated inside the printer chassis stain the printing sheet, and causes a problem of a lower-quality print.

An object of the invention, therefore, is providing an inkjet image-forming apparatus and a printing method which are capable of reducing both the mist production and the influence caused by the produced mist, starting a printing operation earlier under a low-temperature environment, and thereby completing the printing operation in a shorter time.

To achieve the object, a first aspect of the invention is an image forming apparatus comprising: a print-job controller configured to receive a print job and control a printing operation based on the received print job; an ink-ejection driver configured to output a driving signal on the basis of the print job; an ink ejector configured to eject ink onto a paper sheet on the basis of the driving signal outputted by the ink-ejection driver; and an ink-temperature measuring unit configured to measure an ink temperature, wherein when the ink temperature measured by the ink-temperature measuring unit is equal to or higher than a first reference temperature, the ink-ejection driver outputs a driving signal of a first voltage, and wherein when the ink temperature measured by the ink-temperature measuring unit is lower than the first reference temperature and is equal to or higher than a second reference temperature that is lower than the first reference temperature, the print-job controller performs the printing operation as long as predetermined conditions are satisfied for suppressing lowering of print quality possibly caused by ink ejection based on a driving signal of a second voltage that is higher than the first voltage, and the ink-ejection driver outputs the driving signal of the second voltage while the printing operation is being performed.

According to the first aspect of the invention, the inkjet image-forming apparatus, if used under a low-temperature environment, performs printing at the increased ink-ejection speed as long as lowering of print quality which may be caused by the increased ink-ejection speed can be suppressed within a certain level (in terms of printing time or of the number of sheets to be printed, for example). Consequently, the inkjet image-forming apparatus according to the first aspect can achieve both an early print-start time and an early print-finish time while the influence caused by the production of ink mist is reduced.

The print-job controller may measure a printing time that is a length of time elapsed since the printing operation is started, start the printing operation when the ink temperature measured by the ink-temperature measuring unit is lower than the first reference temperature and is equal to or higher than the second reference temperature, and after the start of the printing operation, interrupt the printing operation when the printing time that is being measured reaches a predetermined length of time.

According to the above-described configuration, when the ink is at a low temperature, an appropriate amount of the ink is securely ejected by outputting a driving signal of the second voltage higher than that of the ordinary driving signal. Accordingly, the inkjet image-forming apparatus, if used under a low-temperature environment, can start a printing operation earlier. Note that, limiting the printing period to be within a certain predetermined time length reduces the influence caused by the increase in mist production. For this reason, the aspect of the invention can achieve both an early print-start time and an early print-finish time under a low-temperature environment while the mist production is reduced.

After interrupting the printing operation, the print-job controller may resume the interrupted printing operation when the ink temperature being measured by the ink-temperature measuring unit becomes equal to or higher than the first reference temperature.

According to the above-described configuration, the printing operation, even once interrupted, can be completed. At this time, the ink-ejection driver outputs the driving signal of the first voltage.

The image forming apparatus may further comprise a display configured to display information that the printing operation is currently being interrupted while the printing operation is being interrupted.

According to the above-described configuration, it is possible to inform the user of the fact that the printing operation is currently being interrupted.

The print-job controller may calculate a number of sheets to be printed in the print job when the ink temperature measured by the ink-temperature measuring unit is lower than the first reference temperature and is equal to or higher than the second reference temperature, and perform the printing operation when the calculated number of sheets to be printed is equal to or smaller than a predetermined number.

According to the above-described configuration, when the ink is at a low temperature, an appropriate amount of the ink is securely ejected by outputting a driving signal of a second voltage higher than that of the ordinary driving signal. Accordingly, the inkjet image-forming apparatus, if used under a low-temperature environment, can start a printing operation earlier. Note that, performing a print job in which the number of sheets to be printed is equal to or smaller than a certain predetermined number reduces the influence caused by the increase in mist production. For this reason, the aspect of the invention can achieve both an early print-start time and an early print-finish time under a low-temperature environment while the mist production is reduced.

The print-job controller may calculate an image forming area in the print job when the ink temperature measured by the ink-temperature measuring unit is lower than the first reference temperature and is equal to or higher than the second reference temperature, and perform the printing operation when the calculated image forming area does not include a predetermined area located in peripheral portions of a paper sheet.

According to the above-described configuration, when the ink is at a low temperature, an appropriate amount of the ink is securely ejected by outputting a driving signal of the second voltage higher than that of the ordinary driving signal. Accordingly, the inkjet image-forming apparatus, if used under a low-temperature environment, can start a printing operation earlier. Note that, performing a print job in which the image-forming area of each printing sheet does not include a certain predetermined area located in the peripheral portions of the printing sheet reduces the influence caused by the increase in mist production. For this reason, the aspect of the invention can achieve both an early print-start time and an early print-finish time under a low-temperature environment while the mist production is reduced.

The image forming apparatus may further comprise a sheet-conveying unit configured to convey a paper sheet, wherein the ink ejector includes nozzles configured to eject ink onto the paper sheet on the basis of the driving signal outputted by the ink-ejection driver, wherein the sheet-conveying unit is placed so as to face the nozzles and includes: an endless conveyor belt having ventilation holes therein; and a suction unit configured to generate a sucking force and adsorb the sheet to the conveyor belt with the generated sucking force via the ventilation holes of the conveyor belt, and wherein the paper sheet is conveyed by being adsorbed to the conveyor belt by the sucking force thus generated.

According to the above-described configuration, an early print-start time can be achieved under a low-temperature environment while the influence caused by the mist production is reduced.

In the predetermined area in the peripheral portions of the paper sheet, a part located in each peripheral portion in a sheet-conveying direction may have a width wider than a width of a part located in each peripheral portion in a direction crossing the sheet-conveying direction.

According to the above-described configuration, the predetermined area is set by taking account of the influence of the airflow generated in the printing-sheet conveying direction. Accordingly, even if the printing sheet is conveyed at a faster speed, the inkjet image-forming apparatus can reduce the influence of the mist on the peripheral portions of the printing sheet.

When the ink temperature measured by the ink-temperature measuring unit is lower than the first reference temperature and is equal to or higher than the second reference temperature, the print-job controller may perform a print job for which the printing operation is executable, prior to the other print jobs among the print jobs when receiving a plurality of print jobs.

According to the above-described configuration, the inkjet image-forming apparatus, if used under a low-temperature environment, can achieve a shorter print-waiting time for the entire print jobs.

The image forming apparatus may further comprise an ink-circulation route including an ink storage disposed in a course of the route, the ink-circulation route configured to supply ink to the ink ejector and to send ink having not been ejected by the ink ejector back to the ink storage.

According to the above-described configuration, the inkjet image-forming apparatus uses a larger amount of ink, so that the application of the invention to the inkjet image-forming apparatus is effective.

The ink-circulation route may include an ink heater disposed in the course of the route and configured to heat ink, and the ink heater may heat the ink when the ink temperature measured by the ink-temperature measuring unit is lower than the first reference temperature, and stops heating the ink when the ink temperature becomes equal to or higher than the first reference temperature.

According to the above-described configuration, the inkjet image-forming apparatus can heat the ink up to a temperature range that guarantees a quality for the print.

When receiving from a user an instruction not to perform printing with the ink of a temperature that is lower than the first reference temperature, the print-job controller may not perform the printing operation even when the ink temperature measured by the ink-temperature measuring unit is lower than the first reference temperature and is equal to or higher than the second reference temperature.

Suppose a case where the user instructs the inkjet image-forming apparatus not to perform printing while the ink temperature is lower than the first reference temperature. In this case, according to the above-described configuration, the inkjet image-forming apparatus prevents the ink-ejection driver and the print-job controller from performing their respective actions described above and prevents the ink ejector from ejecting ink even when the ink temperature measured by the ink-temperature measuring unit is within the range below the first reference temperature and either equal to or above the second reference temperature which is lower than the first temperature.

The second reference temperature may be a temperature at which an appropriate amount of ink ejection for printing cannot be secured even when the voltage of the driving signal is raised.

To achieve the object, a second aspect of the invention is a printing method comprising: measuring an ink temperature; receiving a print job; outputting a driving signal on the basis of the received print job, wherein the step of outputting the driving signal including: outputting a driving signal of a first voltage when the measured ink temperature is equal to or higher than a first reference temperature, and outputting a driving signal of a second voltage that is higher than the first voltage when the measured ink temperature is lower than the first reference temperature and is equal to or higher than a second reference temperature that is lower than the first reference temperature while a printing operation is being performed; ejecting ink onto a paper sheet on the basis of the outputted driving signal; and performing the printing operation as long as predetermined conditions are satisfied for suppressing lowering of print quality possibly caused by ink ejection based on the driving signal of the second voltage when the measured ink temperature is lower than the first reference temperature and is equal to or higher than the second reference temperature.

According to the second aspect of the invention, the inkjet image-forming apparatus, if used under a low-temperature environment, performs printing at the increased ink-ejection speed as long as lowering of print quality which may be caused by the increased ink-ejection speed can be suppressed within a certain level (in terms of printing time or of the number of sheets to be printed, for example). Consequently, the inkjet image-forming apparatus according to the second aspect can achieve both an early print-start time and an early print-finish time while the influence caused by the production of ink mist is reduced.

DETAILED DESCRIPTION OF THE EMBODIMENT

Figure 1:
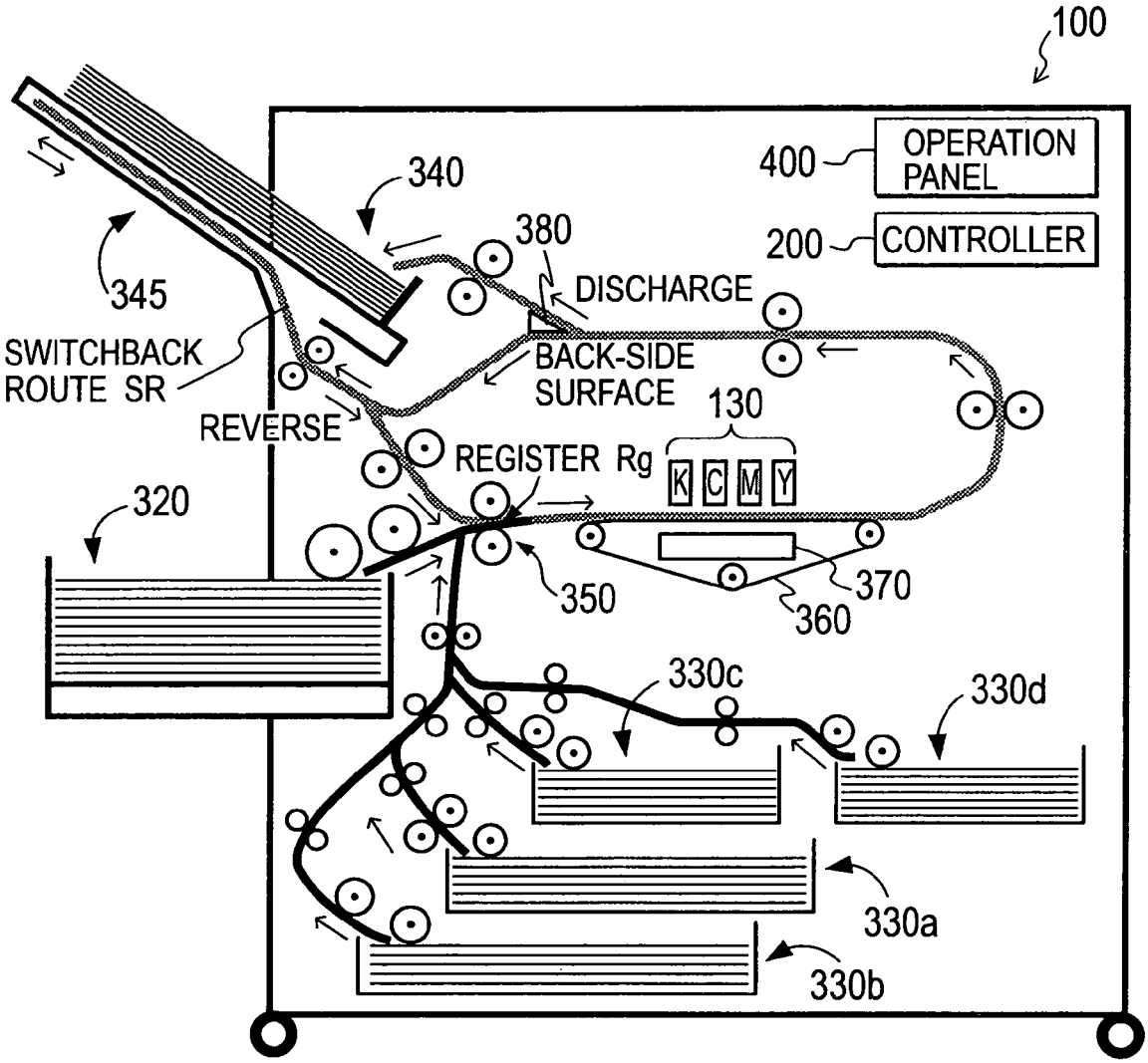
FIG. 1 is a diagram illustrating the overall configuration of an inkjet printer according to a first embodiment to a third embodiment of the invention.

A first embodiment to a third embodiment of the invention will be described below by referring to the drawings.

Configuration of First to Third Embodiments

In the following paragraphs, the configuration of the first to third embodiments of the invention will be described by referring to the drawings. The following description applies to all of the first to third embodiments unless otherwise noted.

FIG. 1 illustrates the overall configuration of an inkjet printer 100 according to the first to third embodiments. FIG. 1 illustrates mainly the routes for conveying printing sheets. As FIG. 1 shows, the inkjet printer 100 includes: a side paper supply table 320, which is exposed outside of the sidewall of the chassis; and plural paper supply trays 330*a*, 330*b*, 330*c*, and 330*d*, which are installed inside the chassis. The side paper supply table 320 and the plural paper supply trays 330*a*, 330*b*, 330*c*, and 330*d* together form a paper feed unit configured to supply printing sheets. In addition, the inkjet printer 100 includes a paper delivery opening 340. The paper delivery opening 340 serves as a paper delivery unit. Once the printing of a paper sheet is completed, the paper sheet will be discharged through the paper delivery opening 340.

The inkjet printer 100 is an inkjet-type color line printer. An inkjet-type color line printer includes plural inkjet heads that serves as a printing unit. Each inkjet head extends in a direction that is orthogonal to the sheet-conveying direction and has multiple nozzles formed therein. Each inkjet head ejects either a black ink or a color ink. The inkjet-type color line printer thus forms images line by line.

The inkjet printer 100 includes a controller 200, an operation panel 400, and other functional units (not illustrated). The controller 200 includes a controller board and the like on which a CPU, a memory, and the like are mounted. The operation panel displays menus, and receives the user's instructions.

Printing sheets which are fed, one by one, from the paper feed unit, or specifically from one of the side paper supply table 320 and the paper supply trays 330*a* to 330*d* are conveyed, by a driving mechanism including rollers, along a paper-feeding conveyor route (indicated by black thick line in FIG. 1) located inside the chassis, and reaches a register Rg. The register Rg is provided for positioning the leading end of the printing sheet and for correcting obliquely directed printing sheets and includes a pair of register rollers 350. The fed printing sheet is stopped temporarily at the register Rg, and then is conveyed toward the printing unit at a predetermined timing.

Plural inkjet heads 130 are provided downstream of the register Rg in the sheet-conveying direction. In the first to third embodiments, black (K), cyan (C), magenta (M), and yellow (Y) inkjet heads 130 are sequentially arranged in this order from the register Rg side. A circular conveyor belt 360 provided so as to face inkjet heads 130 conveys the printing sheet at a speed determined in accordance with the printing conditions. While being conveyed by the conveyor belt 360, images are formed on the printing sheet line by line by the ink ejected from the inkjet heads 130. A vacuuming fan 370 is provided inside the conveyor belt 360. Multiple ventilation holes are formed in the surface of the conveyor belt 360. While the printing sheet is being conveyed by the conveyor belt 360, the printing sheet is kept on attaching to the conveyor belt 360 with the help of a sucking force generated by rotation of the vacuuming fan 370.

Once the printing on a printing sheet is completed, the printing sheet is furthermore conveyed inside the chassis by a driving mechanism including rollers. In the case of single-side printing where the printing is executed for only one of the two surfaces of the printing sheet, the printing sheet is led to and directly discharged through the paper delivery opening 340. Printing sheets are then stacked, each having the printed surface facing downward, one upon another on top of a paper receiving tray 345, which is provided to serve as a receiving tray for the paper delivery opening 340. The paper receiving tray 345 has a shape of tray protruding from the chassis, and has a certain thickness. The paper receiving tray 345 slopes. A wall is formed on the bottom side of the sloping paper receiving tray 345. Printing sheets having been discharged through the paper delivery opening 340 slip downward along the sloping surface of the paper receiving tray 345, and thus are automatically arranged neatly to be laid one upon another.

In a case of double-side printing where the printing is executed for both of the two surfaces of the printing sheet, when the printing on the front-side surface (note that the "front-side surface" refers to a surface firstly printed, and that a surface subsequently printed is referred to as the "back-side surface") is completed, the printing sheet is not led to the paper delivery opening 340, but continues to be further conveyed inside the chassis. The inkjet printer 100 is equipped with a switching mechanism 380 configured to switch conveying routes to the one for the printing on the back-side surface. The printing sheet that has not been led to the paper delivery opening 340 at the switching mechanism 380 is drawn to a switchback route SR, where a switching-back operation is performed on the printing sheet to invert the front-side and back-side surfaces of the printing sheet relative to the conveying route. Subsequently, the printing sheet is led, by a driving mechanism including rollers, again to the register Rg, and then is stopped temporarily. After that, the printing sheet is conveyed toward the printing unit at a predetermined timing, and printing on the back-side surface is executed following a similar procedure to the one for the front-side surface. Once the printing on the back-side surface is completed and thus the printing sheet has images formed on both of its two surfaces, the printing sheet is led to and discharged through the paper delivery opening 340. Printing sheets are thus stacked one upon another on top of the paper receiving tray 345, which is provided to serve as a receiving tray for the paper delivery opening 340.

In the inkjet printer 100, the switching-back operation needed for double-side printing is performed using a space formed inside the paper receiving tray 345. The space formed inside the paper receiving tray 345 is covered so as to prevent the printing sheet from being taken out to the outside during the switching-back operation. This configuration prevents the user from accidentally pulling out the printing sheet while the switching-back operation is being performed on the printing sheet. In addition, the paper receiving tray 345 is provided originally to the inkjet printer 100. Therefore, the use of the space inside the paper receiving tray 345 for the switching-back operation eliminates the need for providing an additional space for the switching-back operation somewhere inside the inkjet printer 100. Accordingly, an increase in the size of the chassis can be avoided. In addition, since the paper delivery opening 340 is not used as a part of the switchback route SR, the switching-back operation on a printing sheet can be performed in parallel with the discharging of another printing sheet.

Figure 2:
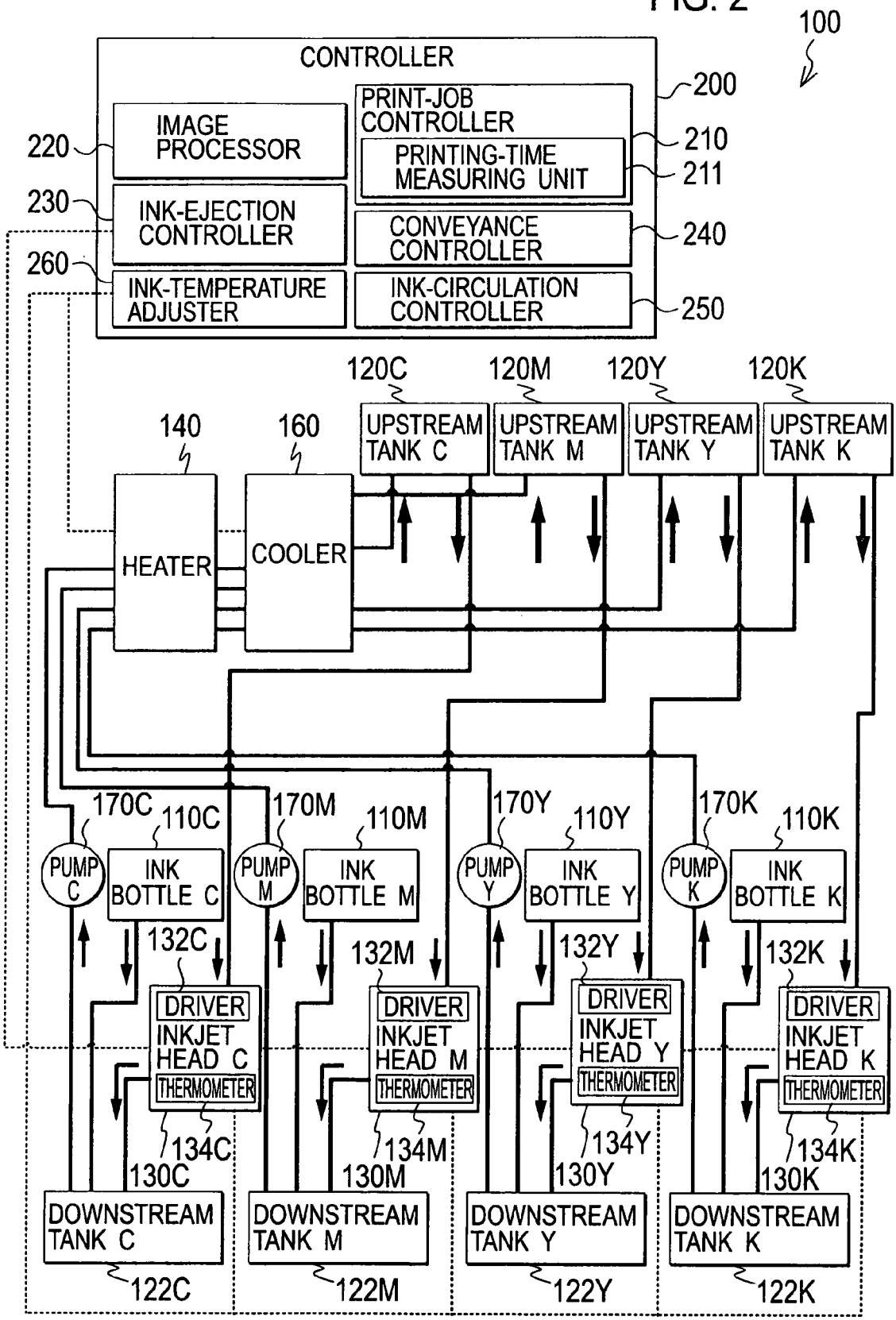
FIG. 2 is a diagram for describing the configuration of a mechanism associated with ink routes and the configuration of a controller according to the first embodiment of the invention.
Figure 10:
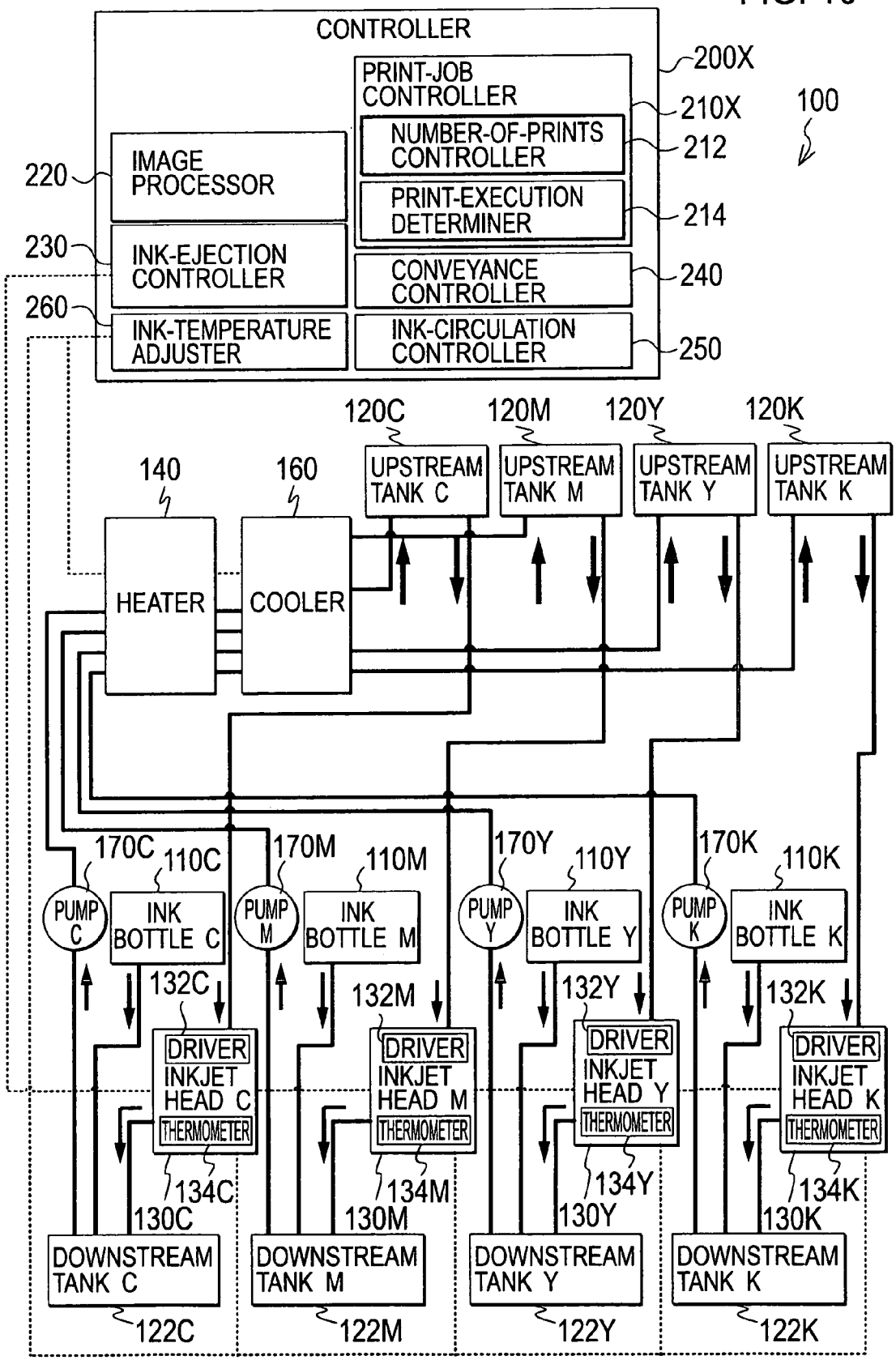
FIG. 10 is a diagram for describing the configuration of a mechanism associated with ink routes and the configuration of a controller of an inkjet printer according to a second embodiment of the invention.
Figure 15:
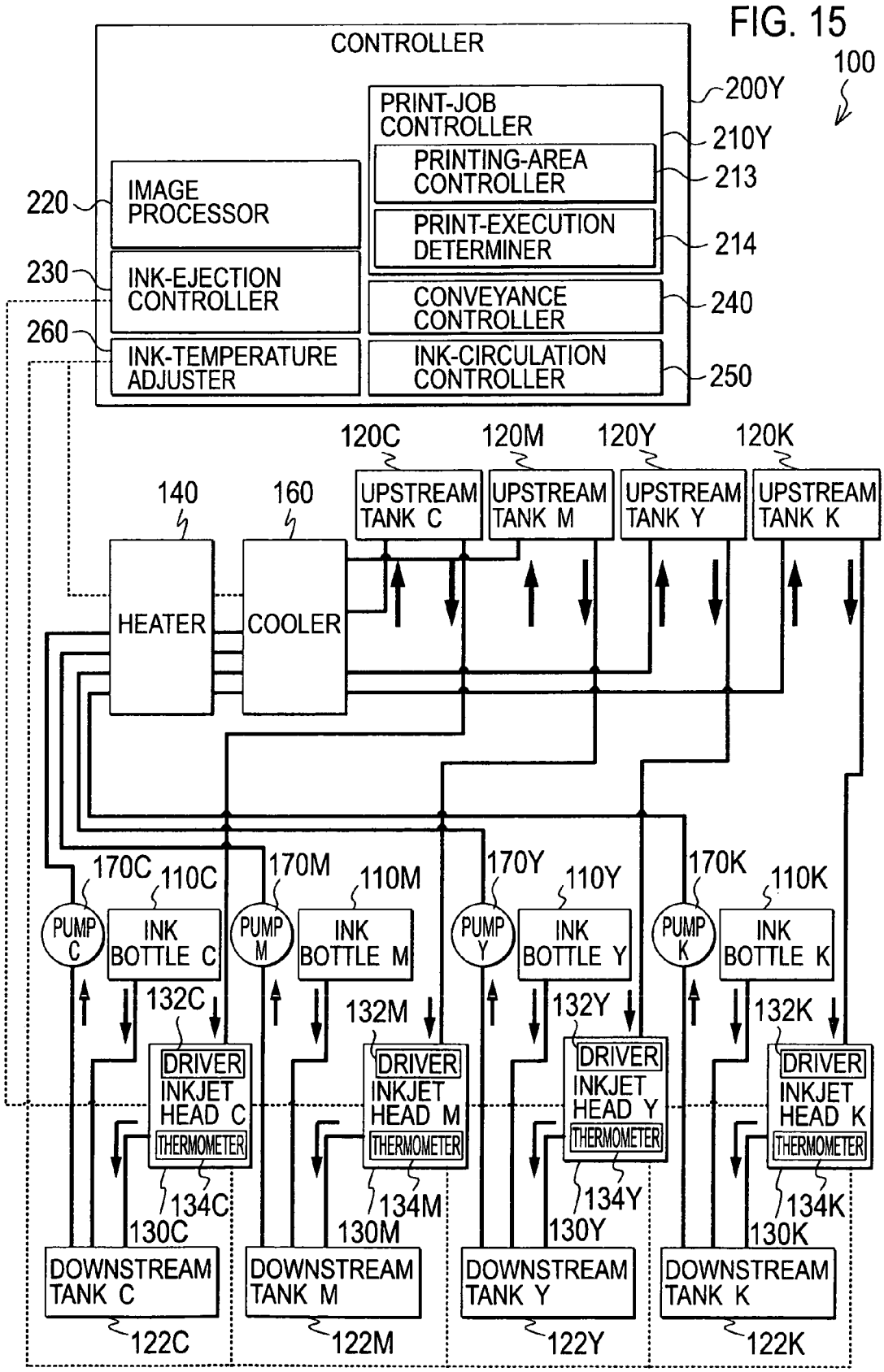
FIG. 15 is a diagram for describing the configuration of a mechanism associated with ink routes and the configuration of a controller of an inkjet printer according to a third embodiment of the invention.

FIG. 2 describes the configuration of a mechanism associated with ink routes and the configuration of the controller 200 included in the inkjet printer 100 according to the first embodiment of the invention. FIG. 10 describes the configuration of a mechanism associated with ink routes and the configuration of a controller 200X included in the inkjet printer 100 according to the second embodiment of the invention. FIG. 15 describes the configuration of a mechanism associated with ink routes and the configuration of a controller 200Y included in the inkjet printer 100 according to the third embodiment of the invention. As FIGS. 2, 10, and 15 show, the inkjet printer 100 is a color printer that performs printing using ink of four colors C, M, Y, and K. The ink of each color is supplied from an ink bottle 110, which is detachably attached to the inkjet printer 100. Specifically, the ink jet printer 100 includes as the ink bottle 110: an ink bottle 110C that supplies cyan ink; an ink bottle 110M that supplies magenta ink; an ink bottle 110Y that supplies yellow ink; and an ink bottle 110K that supplies black ink. Note that, in the following description, each of these ink bottles 110C, 110M, 110Y, and 110K are represented by a common term "inkbottle 110" if the color of ink makes no difference in what is described. The same usage is applied also to terms of other functional units.

The ink supplied from the ink bottle 110 passes through an ink route formed by a pipe made of a resin, a metal, or the like, and is then stored, temporarily, in a downstream tank 122 provided downstream of the inkjet head 130. To this end, the inkjet printer 100 includes as the downstream tank 122: a downstream tank 122C to store the cyan ink; a downstream tank 122M to store the magenta ink; a downstream tank 122Y to store the yellow ink; and a downstream tank 122K to store the black ink.

The ink stored in the downstream tank 122 is sent by a pump 170 to an upstream tank 120 provided upstream of the inkjet head 130. To this end, the inkjet printer 100 includes a pump 170C, a pump 170M, a pump 170Y, and a pump 170K as the pump 170, as well as an upstream tank 120C, an upstream tank 120M, an upstream tank 120Y, and an upstream tank 120K as the upstream tank 120. The ink sent to the upstream tank 120 is then sent to the inkjet head 130 in which multiple nozzles to eject the ink are formed, and then used for forming images.

As described above, the inkjet printer 100 includes: the inkjet head 130C that ejects the cyan ink; the inkjet head 130M that ejects the magenta ink; the inkjet head 130Y that ejects the yellow ink; the inkjet head 130K that ejects the black ink. Each of the first to third embodiments employs an inkjet head of a type that uses a piezoelectric element for the purpose of producing a jet of ink. Note that an inkjet head of a different type may be used, instead, which uses a heat element to heat ink to produce bubbles for the purpose of producing a jet of ink.

The inkjet head 130 includes a driver 132 (specifically, drivers 132C, 132M, 132Y, and 132K) that outputs a driving signal to drive the piezoelectric element in accordance with ink-ejection data sent from the corresponding one of the controllers 200, 200X, and 200Y. Note that the inkjet printer 100 is an ink-circulation type inkjet printer that circulates the ink therein. The ink that is not consumed by the inkjet head 130 at the current image formation is sent back to the downstream tank 122. The ink is returned from the upstream tank 120 via the inkjet head 130 to the downstream tank 122 by taking advantage of the water head differences among these members.

Each ink has a proper temperature range in which a certain printing quality is guaranteed. Accordingly, when the environment temperature is low and the temperature of ink is below the printing-quality guaranteeing temperature range, the ink has to be heated. To this end, a heater 140 is provided in the course of the ink route. The drivers 132 and the piezoelectric elements, on the other hand, generate heat when activated. Not only the heat thus generated but also the Joule heat caused by the vibrations of ink increases the ink temperature. The influence of the ink-temperature increase has to be reduced while the environment temperature is high. To this end, a cooler 160 is provided to cool the ink down. The ink that has passed through the heater 140 and the cooler 160 is then sent to the upstream tank 120.

The inkjet heads 130 are provided respectively with thermometers 134 (specifically, thermometers 134C, 134M, 134Y, and 134K) which measure the ink temperature either directly or indirectly.

Each of the controllers 200, 200X, and 200Y is a functional unit which controls the print-job processing, the ink temperature, and other processing in the inkjet printer 100. Each of the controllers 200, 200X, and 200Y provided respectively in the first to third embodiments includes an image processor 220, an ink-ejection controller 230, a conveyance controller 240, an ink-circulation controller 250, and an ink-temperature adjuster 260. In addition, the controller 200 of the first embodiment includes a print-job controller 210. The controller 200X of the second embodiment includes a print-job controller 210X. The controller 200Y of the third embodiment includes a print-job controller 210Y.

Each of the print-job controllers 210, 210X, and 210Y controls the execution of, the interruption of, the resumption of the print jobs that each of the print-job controllers 210, 210X, and 210Y receives from the user, the handling of errors and the recording of logs. The print jobs received from the user includes: a printing processing based on print data sent from a computer; a copying processing based on image data read by an image reading apparatus; a facsimile printing processing based on image data sent over telephone lines.

When the printing is executed under a low ink temperature, the print-job controller 210 of the first embodiment interrupts the printing operation, as described later, on condition that certain predetermined conditions (print-interruption conditions) are satisfied after the start of printing execution. The print-interruption conditions may be determined as a fact such that a certain predetermined length of printing time has passed. In this way, the production of mist can be reduced. To this end, the print-job controller 210 includes a printing-time measuring unit 211 configured to measure the time length that has been elapsed from the start of the printing operation.

When the printing is executed under a low ink temperature, the print-job controller 210X of the second embodiment starts executing the printing operation, as described later, on condition that the print job satisfies certain predetermined conditions (print-start conditions). The print-start conditions may be determined as a fact such that printing is executed on a certain predetermined number of sheets (or allowable number of sheets) or less. In this way, the production of mist can be reduced. To this end, the print-job controller 210X includes a number-of-prints calculator 212 and a print-execution determiner 214.

The number-of-prints calculator 212 counts the number of sheets to be printed when the print job of the processing target is executed. The number of sheets to be printed may be obtained by multiplying the number of pages by the number of sets needed.

When the printing is executed under a low ink temperature, the print-job controller 210Y of the third embodiment starts executing the printing operation, as described later, on condition that the print job satisfies certain predetermined conditions (print-start conditions). The print-start conditions may be determined as a fact that the printing area does not include a predetermined area located in the peripheral portions of the printing sheet. In this way, the production of mist can be reduced. To this end, the print-job controller 210Y includes a printing-area calculator 213 and a print-execution determiner 214.

The printing-area calculator 213 calculates the geometrical area within a printing sheet in which images are formed when the print job of the processing target is executed. The geometrical area in which images are formed is the geometrical area onto which the ink is ejected. If the print job includes plural pages, the geometrical area is calculated for each page.

The print-execution determiner 214 determines, on the basis of either the calculation result of the number-of-prints calculator 212 or the calculation result of the printing-area calculator, whether or not the print job of the processing target is to be executed. Specifically, with a low-temperature ink, a print job is to be executed so as to perform the printing operation either on condition that the print job includes a certain predetermined number of sheets or less to be printed or the printing area of the print job does not include a certain predetermined area located in the peripheral portions of the printing sheet. Any print job that satisfies the above-described conditions can be executed while the influence of the mist production can be reduced.

In addition, each of the print-job controllers 210, 210X, and 210Y may receive, from the user, an instruction to select whether or not a earlier print start is executed when the temperature of the ink is low.

The image processor 220 executes image processing on image data that is the target for the print job. The kinds of image processing executed by the image processor 220 include: the development processing of the print data; color-conversion processing of the image data; the binarization processing; the halftone processing; and the like. On the basis of the image data after the image processing, the ink-ejection controller 230 calculates the amount of ink ejection for each dot, and then outputs the calculated amount of ink ejection to the drivers 132 of the inkjet heads 130. Note that each inkjet head 130 expresses the tone by the number of ink droplets to be ejected. Highlight portions in the image are expressed by a smaller number of ink droplets whereas shadow portions in the image are expressed by a larger number of ink droplets.

The conveyance controller 240 controls the actions of the register rollers 350, of the conveyor belt 360, and of the other conveyor mechanisms to convey the printing sheets. The ink-circulation controller 250 makes the ink circulate in the ink-circulation route by controlling the actions of the pumps 170 and the like. The ink-temperature adjuster 260 controls the ink temperature so that the ink temperature is within a proper temperature range by activating either the heater 140 or the cooler 160 in accordance with the measurement results of the thermometers 134 provided respectively in the inkjet heads 130.

Figure 3:
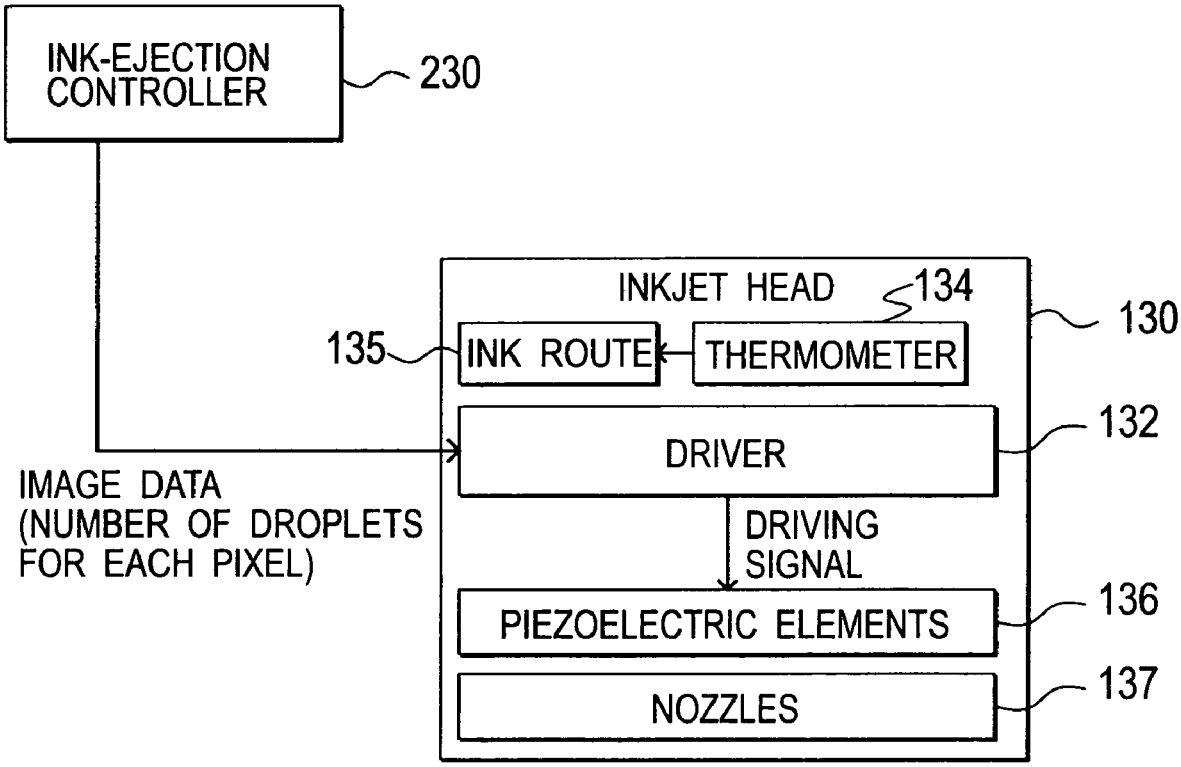
FIG. 3 is a block diagram illustrating the configuration of an inkjet head according to the first embodiment to the third embodiment of the invention.

FIG. 3 is a block diagram illustrating the configuration of the inkjet head 130. As FIG. 3 shows, the ink is supplied to the inkjet head 130 via an ink route 135 that forms a part of the ink-circulation route. The inkjet head 130 includes the thermometer 134 that measures the temperature of the ink flowing through the ink route 135.

The control data which are outputted by the ink-ejection controller 230 and which represent the numbers of ink droplets to be ejected respectively for the pixels are inputted into the drivers 132. On the basis of the control data, each driver 132 outputs a driving signal of a certain predetermined voltage to piezoelectric elements 136. The deformation of the piezoelectric elements 136 caused by the driving signals causes nozzles 137 to eject the ink. Accordingly, the piezoelectric elements 136 and the nozzles 137 function as an ink ejector. In addition, the drivers 132 function as an ink-ejection driver. When the ink temperature is low, each driver 132 outputs to the piezoelectric elements 136 a driving signal with a higher voltage than that of the ordinary driving signal.

(Print-Execution Processing of the First to Third Embodiments)

Subsequently, the print-execution processing according to the first and the third embodiments will be described below. In the first to third embodiments, the lower-limit value of the appropriate temperature range of the ink is defined as a first reference temperature. The first reference temperature may be set, for example, at 25° C. Accordingly, when the ink temperature is lower than 25° C., the ink-temperature adjuster 260 activates the heater 140 so as to heat the ink. In the meanwhile, the ink-circulation controller 250 makes the ink circulate.

If the printing is not executed until the ink temperature becomes 25° C. or higher, when the ink temperature is low, it takes a longer time to start printing. Since the inkjet printer 100 of each of the first to third embodiments is an ink-circulation type inkjet printer, there is a larger amount of ink to be heated. Accordingly, it takes much longer time for the ink to be heated up to a satisfactory level.

For this reason, a second reference temperature of the ink temperature is determined. The printing is executed, if the user wants it, on condition that the ink temperature is equal to or higher than the second reference temperature. Note that the second reference temperature is set at a lower temperature than the first reference temperature, and may be set at 20° C., for example. Note also that an ink temperature lower than the first reference temperature increases the viscosity of the ink, so that the proper amount of ink ejection cannot be secured. To address this problem, the voltage of the driving signal outputted to the piezoelectric elements 136 is made larger than that of the ordinary driving signal. In this way, the proper amount of ink ejection can be secured.

Figure 4A:
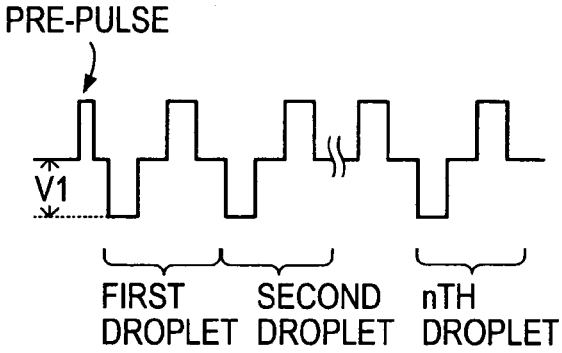
FIGS. 4A and 4B are diagrams each illustrating a driving signal with a variable voltage according to the first to third embodiments of the invention.
Figure 4B:
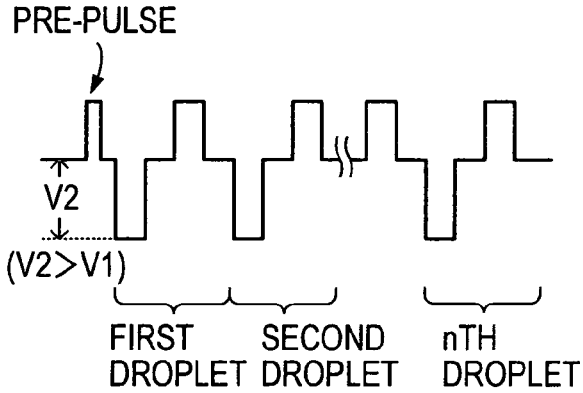

Each of FIGS. 4A and 4B illustrates an exemplar driving signal outputted to the piezoelectric elements 136. FIG. 4A illustrates a driving signal outputted in the ordinary occasions whereas FIG. 4B illustrates a driving signal outputted when the temperature is low. For each single droplet, the driving signal applied to each of the piezoelectric elements includes a set of a negative-voltage pulse and a positive-voltage pulse. The negative-voltage pulse expands the ink chamber whereas the positive-voltage pulse contracts the ink chamber. Accordingly, for each pixel of plural droplets, the pulse set is applied to the corresponding piezoelectric element repeatedly for a plural number of times. In addition, to obtain a stable amount of ink ejection, a shorter pulse known as a pre-pulse is inserted before the first pulse set.

According to the first to third embodiments, in an ordinary occasion where the measured value of the ink temperature is equal to or higher than the first reference temperature, a driving signal of a voltage V1 (first voltage V1) is outputted to the piezoelectric element, as shown in FIG. 4A. In a low-temperature occasion where the measured value of the ink temperature is below the first reference temperature, but equal to or higher than the second reference temperature, a driving signal of a voltage V2 (second voltage V2) that is larger than the first voltage V1 is outputted to the piezoelectric element, as shown in FIG. 4B.

A larger driving voltage, however, accelerates the ink-ejection speed and increases the mist production. The increased mist production, in turn, increases the mist attached to the inside of the printer chassis, resulting in a problem that the mist flying about in the chassis and the mist accumulated in the chassis stain the printing sheet, and thus lower the print quality. To address this problem, in the first to third embodiments, both the mist production and the influence of the mist production are reduced by following print-execution procedures which will be described below. Note that, for the sake of simplicity, the following description will not deal with an occasion where the ink temperature is so high as to exceed the proper temperature range.

Embodiment 1

Figure 5:
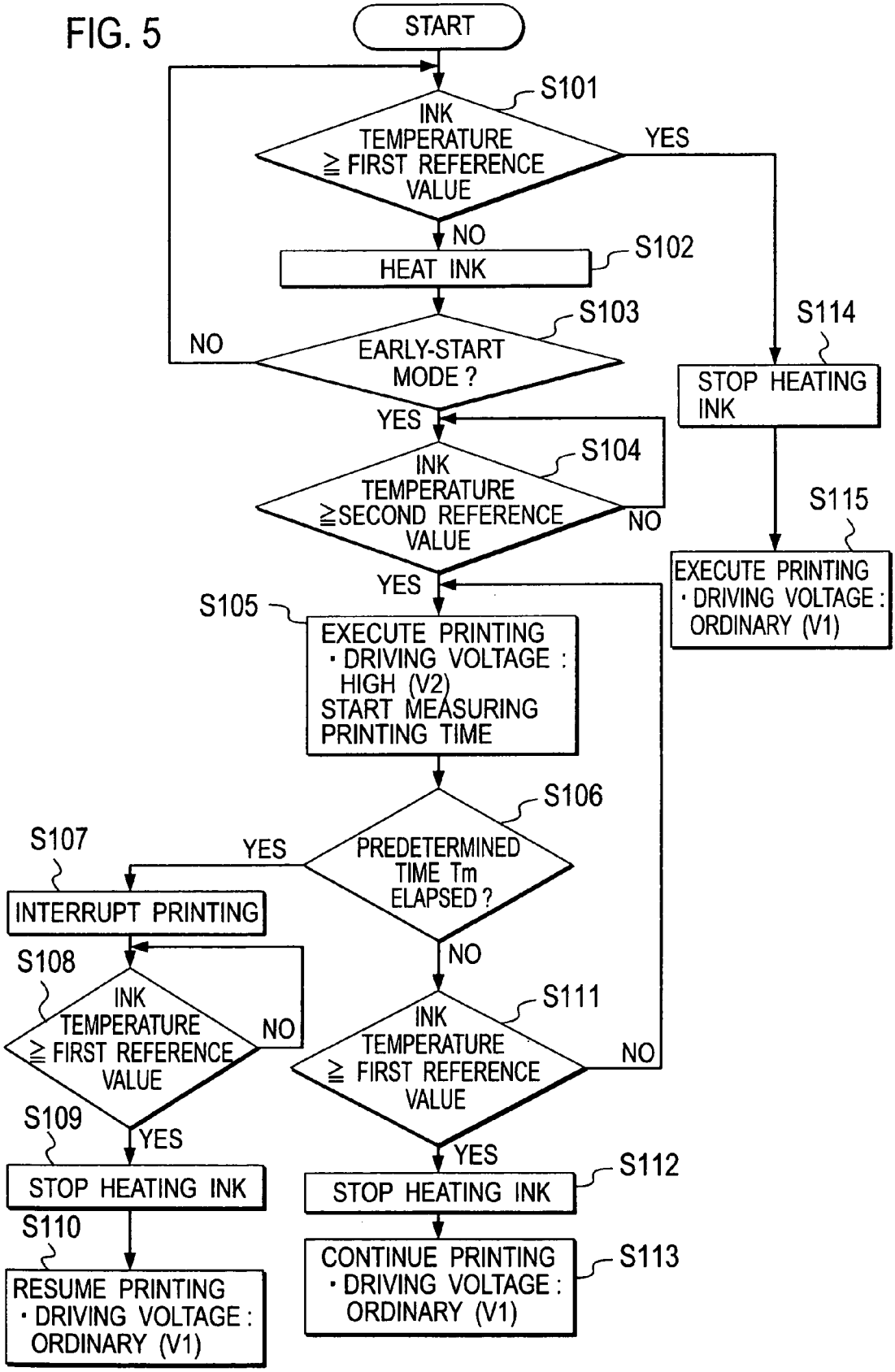
FIG. 5 is a flowchart for describing a print-execution procedure according to the first embodiment of the invention.

FIG. 5 is a flowchart illustrating a print-execution procedure according to the first embodiment of the invention. In the first embodiment, the printing execution under a low-temperature environment is controlled in terms of the print-interruption conditions that "a certain predetermined length of printing time has passed."

Firstly, if the measured value of ink temperature is equal to or higher than the first reference temperature, e.g., 25° C., (S101: Yes), it is determined that the ink temperature is within the proper temperature range, and the printing processing for ordinary occasions (hereafter, simply referred to as the "ordinary printing processing") is executed (S115). In this case, if the ink is being heated, the heating of ink is stopped (S114) before the execution of the printing processing. If the inks of different colors have different measured values of temperature from one another, the determination may be based, for example, on the average value of all the measured values of ink temperature, or on the lowest one of all the measured values of ink temperature. In the ordinary printing processing, each driver 132 outputs to the corresponding piezoelectric elements 136 the driving signal that has a first voltage V1 for ordinary occasions that is high enough to secure a proper ejection amount of ink while the ink temperature is within the proper temperature range.

In contrast, if the measured value of ink temperature is lower than the first reference temperature, e.g., 25° C., (S101: No), the ink-temperature adjuster 260 activates the heater 140 to heat the ink (S102) until the ink temperature is raised up to a proper temperature.

If the user does not instruct the inkjet printer 100 to execute earlier print start with low-temperature ink (S103: No), the inkjet printer 100 does not start executing the printing processing but waits until the measured value of ink temperature reaches the first reference temperature or higher. When the measured value of ink temperature reaches the first reference temperature or higher (S101: Yes), the heating of the ink is stopped (S114), and the ordinary printing processing is executed (S115).

If the user wants the inkjet printer 100 to execute the earlier print start with low-temperature ink, the user may set, for example, the execution of the earlier print start on the printer driver, through which instructions for the printing are given. Alternatively, the user may set the execution of the earlier print start using the operation panel 400 of the inkjet printer 100. Still alternatively, the administrator may set default as to whether or not the earlier print start is to be executed.

If the user instructs the inkjet printer 100 to execute earlier print start with low-temperature ink (S103: Yes), whether or not the measured value of ink temperature is equal to or above the second reference temperature, e.g., 20° C., is determined (S104). If the measured value of the ink temperature is lower than the second reference temperature (S104: No), the inkjet printer 100 waits until the measured value of ink temperature reaches the second reference temperature or higher. This is because the viscosity of the ink of a lower temperature than the second reference temperature is so large that even the driving signal of a higher voltage cannot secure the proper amount of ink ejection. To put it differently, the second reference temperature is determined at a temperature that prevents the driving signal of the larger voltage from providing the proper amount of ink ejection.

If the measured value of the ink temperature is equal to or higher than the second reference temperature (S104: Yes), the inkjet printer 100 executes the printing processing (S105). To secure the proper amount of ink ejection, the driving signal that has a higher second voltage V2 than the ordinary first voltage V1 is outputted to the piezoelectric elements 136 (S105).

In this way, even with the low-temperature ink, the proper amount of ink ejection can be secured. The higher second voltage V2, however, increases the ink-ejection speed and thus the mist production, as well. In the first embodiment, to reduce the influence of the increase in mist production, the printing with the low-temperature ink lasts only for a predetermined time length Tm. To this end, when the printing operation starts, the measuring of the printing time is started (S105).

The printing with the low-temperature ink lasts only within the predetermined time length Tm for the following reason. Along with the mist production, the mist thus produced is accumulated inside the printer chassis. Although a higher second voltage V2 increases the mist production, a single print job that does not take a long time does not cause very large amount of mist to be accumulated. Accordingly, a printing operation is considered to be allowable if the printing operation takes as short as the predetermined time length Tm or shorter. For this reason, the predetermined time length Tm may be determined in advance by way of an experiment, for example, by taking account of the amount of mist to be accumulated by a single print job, the average coverage rate, the amount of mist accumulation or the number of prints that needs a maintenance work for the inside of the printer chassis.

Figure 6:
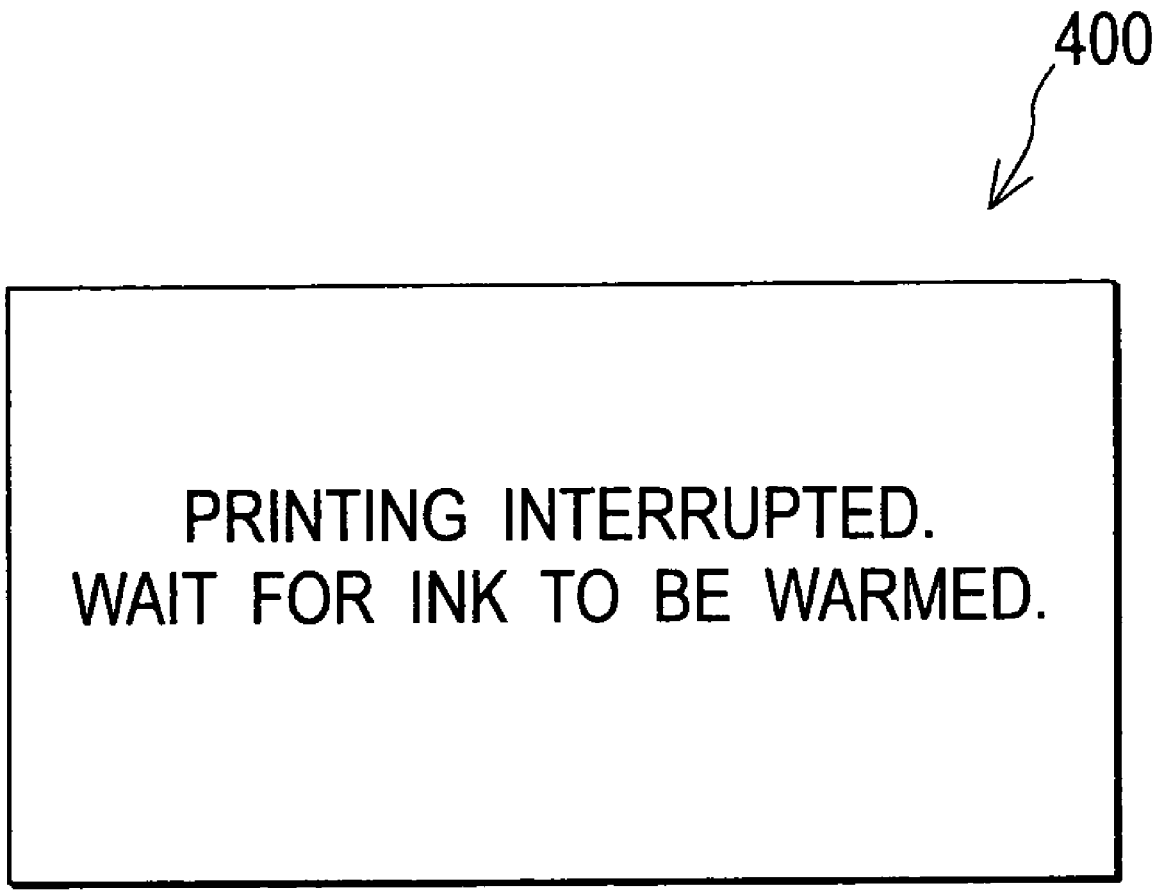
FIG. 6 is a diagram illustrating an exemplar screen displayed while the printing is being interrupted.

If the printing time for the execution of printing with the driving signal of the higher second voltage V2 than the ordinary first voltage V1 exceeds the predetermined time length Tm (S106: Yes), the inkjet printer 100 interrupts the printing operation (S107). Accordingly, the printing operation with the driving signal of the higher second driving voltage V2 that increases the mist production is stopped, so that the mist production can be limited to an amount within an allowable range. In this event, it is preferable that, to indicate the fact that the printing operation is currently being interrupted, the display screen of the operation panel 400 shows that the printing operation is currently being interrupted until the ink becomes sufficiently warm. FIG. 6 shows an example of such a display.

Then, the inkjet printer 100 waits until the measured value of ink temperature reaches the first reference value or higher (S108: No). Once the measured value of ink temperature reaches the first reference temperature or higher (S108: Yes), the heating of the ink is stopped (S109). Then, the printing conditions are changed to those for the printing by the driving signal of an ordinary first voltage V1, and the interrupted printing operation is resumed (S110). Since the printing operation is executed by the driving signal of the ordinary first voltage V1, the mist production by this printing operation is not as large as the mist production by the printing operation executed by the driving signal of the higher second voltage V2.

If the predetermined time length Tm has not elapsed yet (S106: No), and at the same time if the measured value of ink temperature reaches the first reference temperature or higher (S111: Yes) during the execution of the printing with the driving signal of the higher second voltage V2 than the ordinary first voltage V1, the heating of the ink is stopped (S112). The printing operation continues, though the printing processing is executed with the ordinary first voltage V1 of the driving signal and the sheet intervals for ordinary occasions (S113).

Figure 7A:
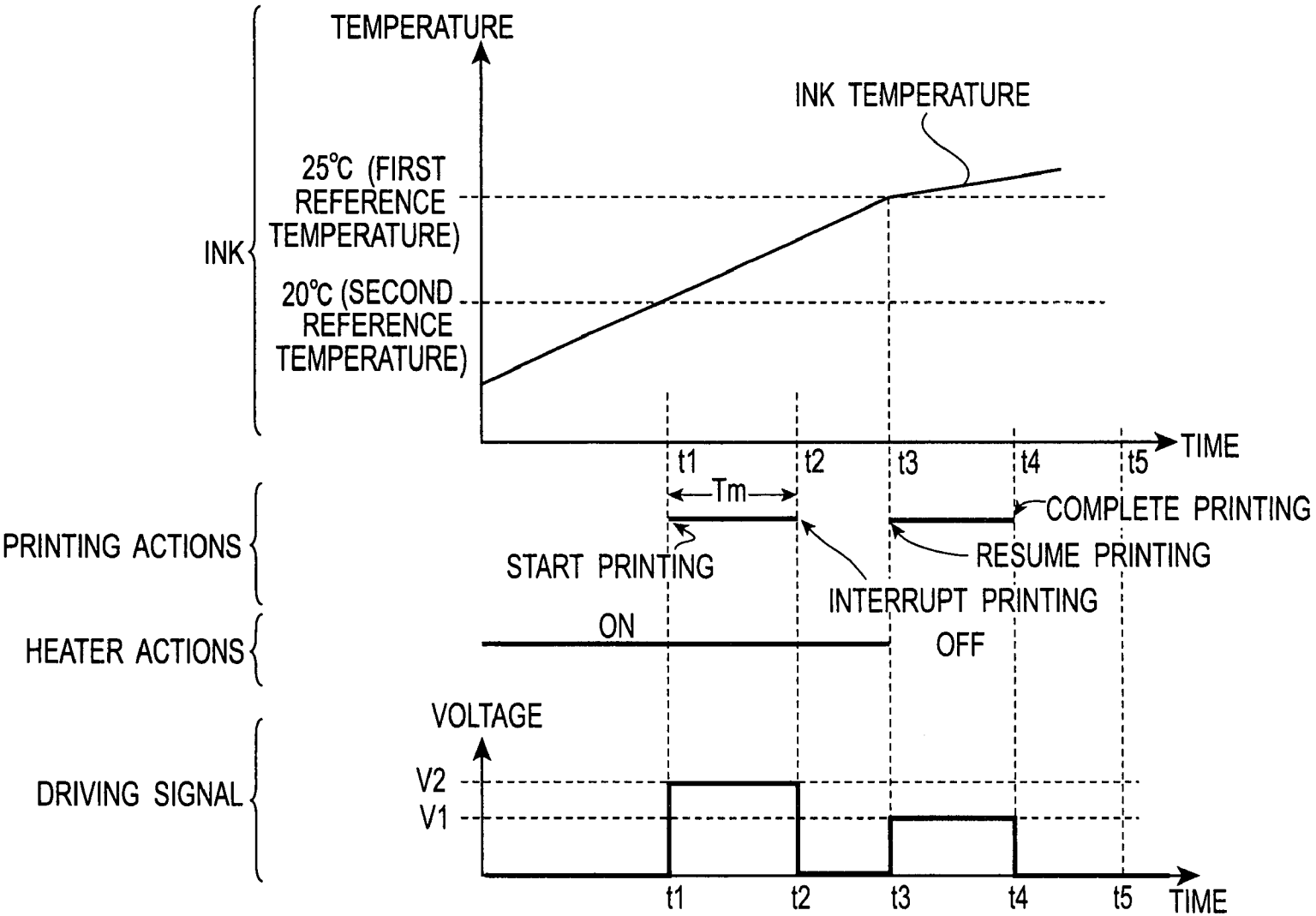
FIG. 7A is a chart illustrating the relationship among the ink temperature, printing actions, and the like in the print-execution procedure according to the first embodiment of the invention.
Figure 7B:
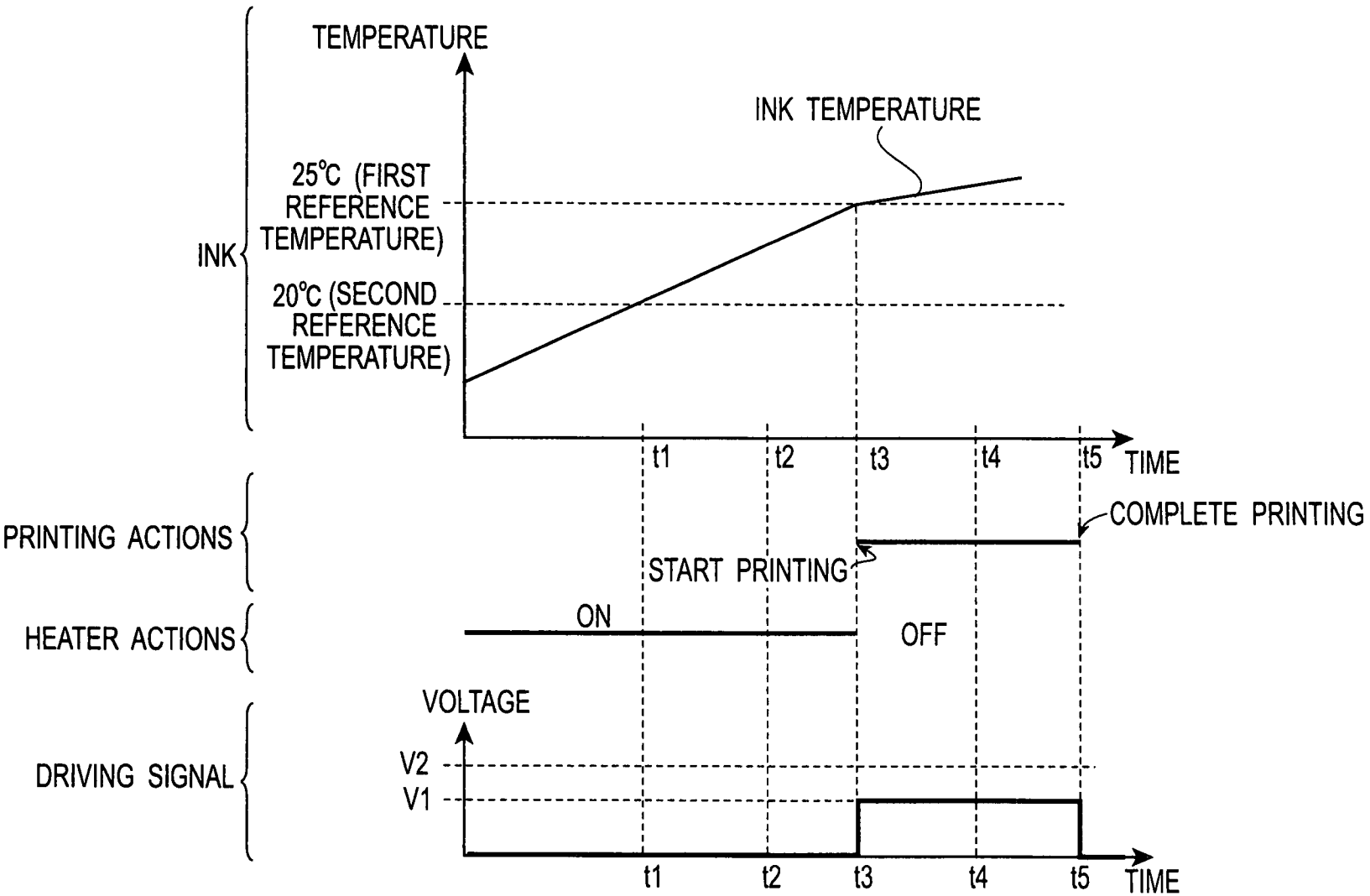
FIG. 7B is a chart corresponding to FIG. 7A and illustrating the relationship among the ink temperature, various printing actions, and the like in a conventional print-execution procedure.

FIG. 7A is a chart illustrating the relationship among the "ink temperature," "printing actions (print start, print interruption, print resumption, and print completion)," "heater actions (On and Off)," and the "driving signals (Off, one with the first voltage V1, and one with the second voltage V2)" in the print-execution procedure according to the first embodiment of the invention. The horizontal axes for the four categories of variables represent time, and the four categories of variables are depicted on the same time axis. The vertical axis for the "ink temperature" represents the temperature of ink. The thick lines for the "printing actions" mean that printing actions are being executed. The thick line for the "heater actions" means that heater is being activated. The vertical axis of the "driving signals" represents the voltage. FIG. 7B is a chart corresponding to FIG. 7A and illustrating the relationship among the "ink temperature," "printing actions," "heater actions," and the driving signals" in a conventional print-execution procedure. The basic configuration of the chart is similar to that of FIG. 7A, so that the description for the basic configuration of FIG. 7B will not be given here. Note that both of FIGS. 7A and 7B are depicted on the same time axis.

In the above-mentioned printing actions of the first embodiment, as FIG. 7A shows, if the measured value of ink temperature is lower than the second reference temperature, the heater 140 is activated to heat the ink, and thereby the inkjet printer 100 can start executing the printing operation at the time t1, at which the ink temperature reaches the second reference temperature. In addition at the time t2, which is the predetermined time Tm after the time t1, the inkjet printer 100 interrupts the execution of printing. At the time t3, at which the ink temperature reaches the first reference temperature, the inkjet printer 100 resumes the execution of the printing that has been interrupted. At the time t4, the inkjet printer 100 completes the execution of printing. In the conventional printing processing, however, as FIG. 7B shows, the printing is started only after the time t3, at which the ink temperature reaches the first reference temperature because of the greater influence of the increase in the mist production caused by the higher second voltage V2 of the driving signal than the ordinary first voltage V1. In addition, in the conventional printing processing, the printing is completed at the time t5, which is later than the time t4. In the first embodiment of the invention, the influence of the increase in the mist production is reduced by limiting the printing time to last within the predetermined time length Tm. Consequently, according to the first embodiment, the inkjet printer 100, if used under a low-temperature environment, can start executing the printing earlier and complete the printing earlier than in the conventional cases while the mist production can be reduced.

Figure 8:
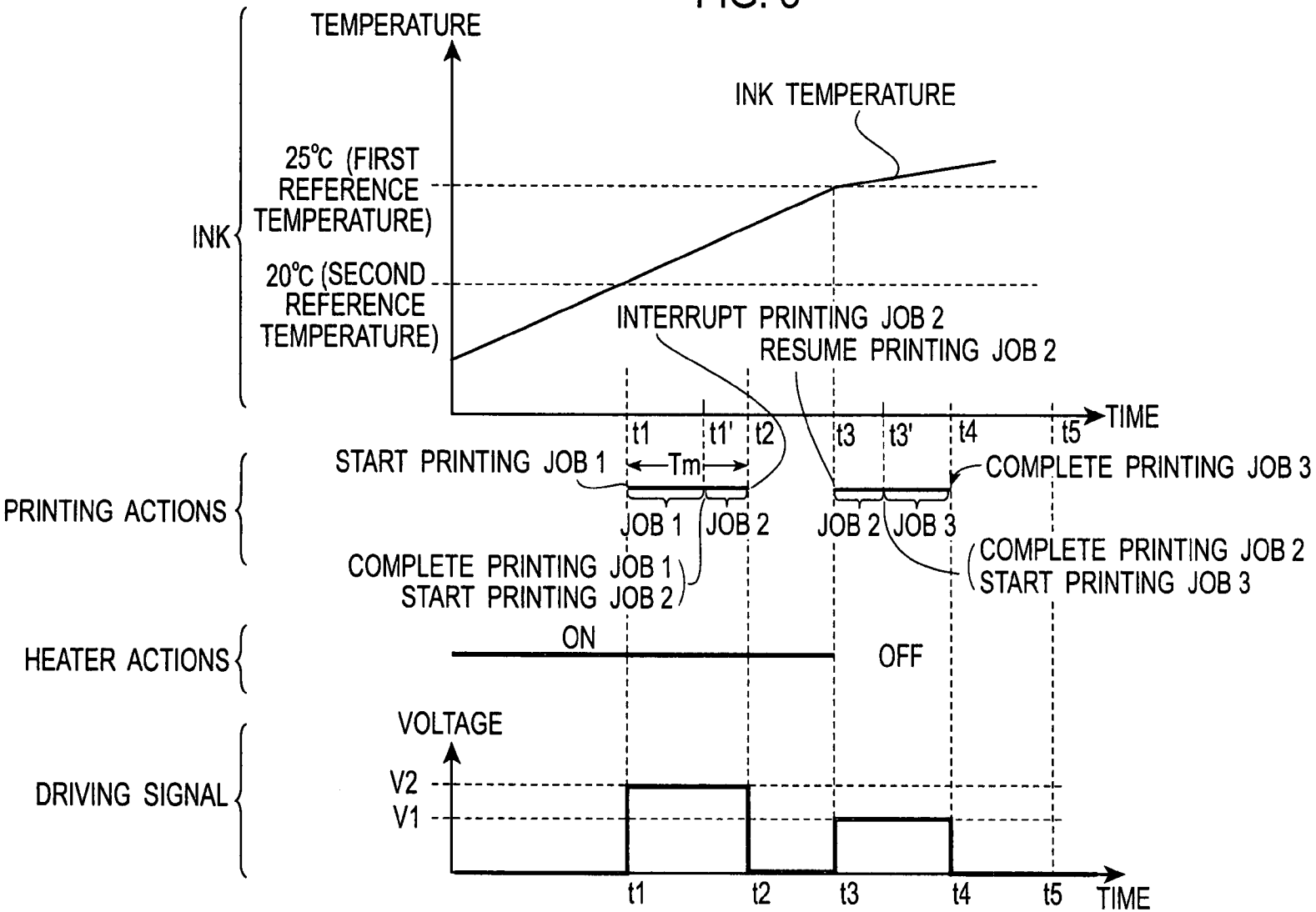
FIG. 8 is a chart for illustrating an exemplar relationship between the times for the printing actions specified in FIG. 7A and plural print jobs.

Suppose a case where plural print jobs (jobs 1 to 3) are involved in the printing actions described in FIG. 7A. FIG. 8 is a chart for describing an exemplar relationship of this case between the times for the various printing actions and plural print jobs. In FIG. 8, at the time t1, at which the ink temperature reaches the second reference temperature, the inkjet printer 100 starts executing the printing operation for the job 1, and at the time t1', the inkjet printer 100 completes the execution of the printing operation for the job 1. At the time t1', since the predetermined time length Tm has not elapsed yet from the time t1, the printing operation for the job 2 is started. At the time t2, which is the predetermined time length Tm after the time t1, the inkjet printer 100 interrupts the execution of the printing operation for job 2. At the time t3, at which the ink temperature reaches the first reference temperature, the inkjet printer 100 resumes the execution of the printing operation for the job 2. At the time t3', the inkjet printer 100 completes the execution of the printing operation for the job 2. The completion of the printing operation for the job 2 is succeeded by the start of the printing operation for the job 3. The inkjet printer 100 completes the execution of the printing operation for the job 3 at the time t4. In this way, according to the first embodiment, even if plural print jobs are involved in the various printing actions specified in FIG. 7A, the inkjet printer 100, if used under a low-temperature environment, can start executing the printing earlier and complete the printing earlier than in the conventional cases while the mist production can be reduced.

Modified Examples of Embodiment 1

Figure 9A:
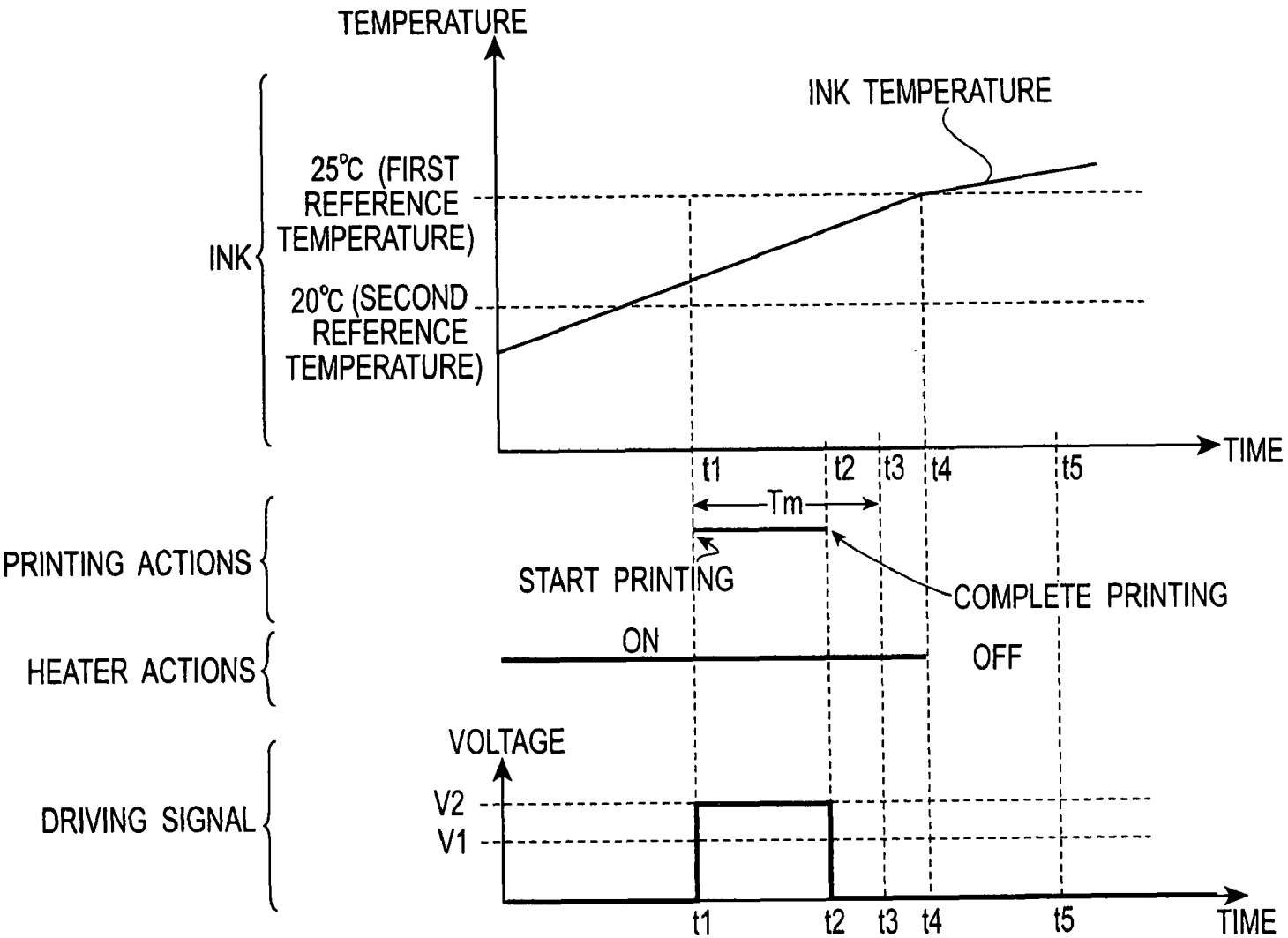
FIG. 9A is a chart illustrating the relationship among the ink temperature, printing actions, and the like in the print-execution procedure according to a first modified example of the first embodiment of the invention.
Figure 9B:
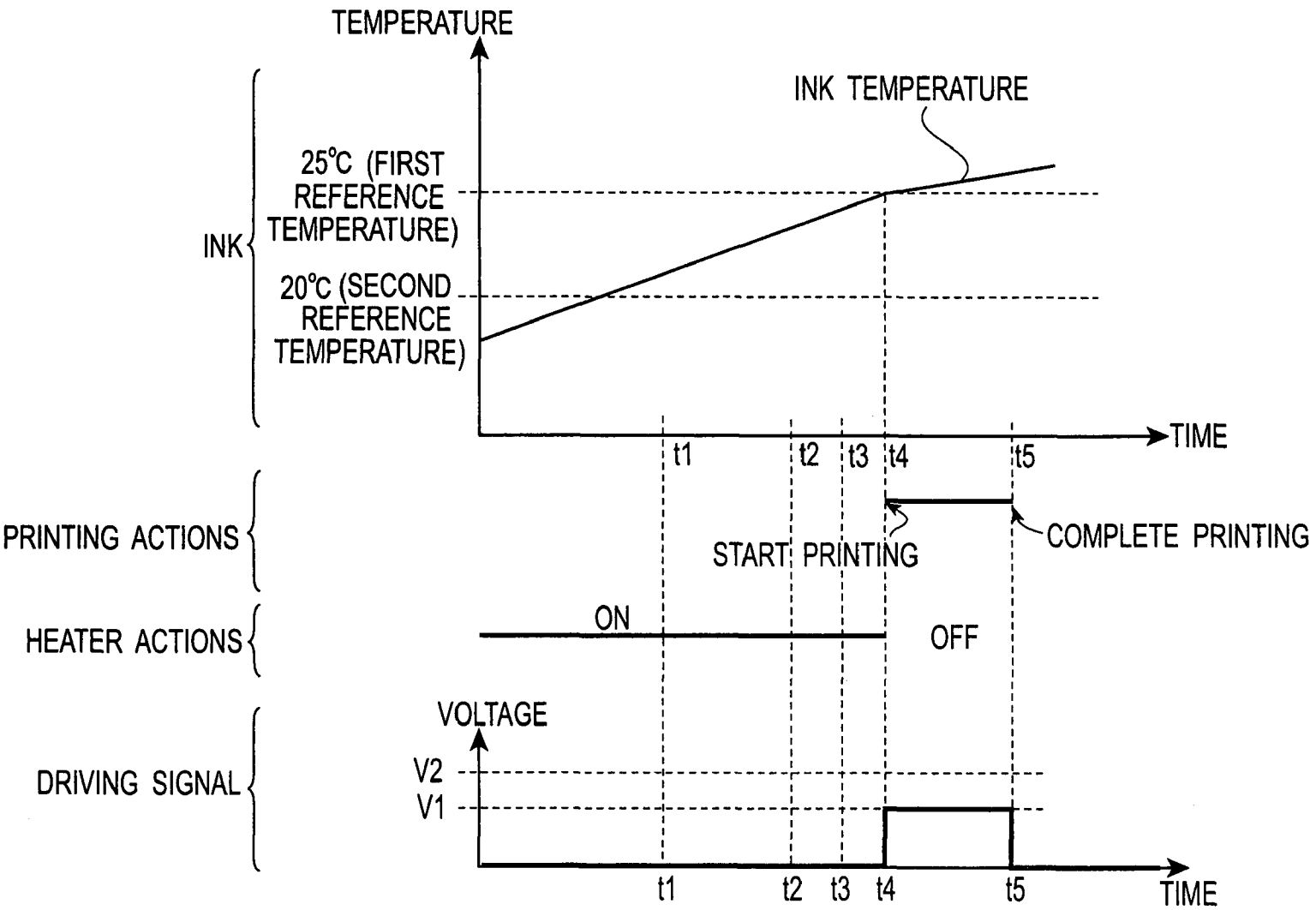
FIG. 9B is a chart corresponding to FIG. 9A and illustrating the relationship among the ink temperature, various printing actions, and the like in a conventional print-execution procedure.

FIG. 9A is a chart illustrating the relationship among the "ink temperature," "printing actions "heater actions," and the "driving signals" in the print-execution procedure according to an modified example of the first embodiment of the invention. FIG. 9B is a chart corresponding to FIG. 9A and illustrating the relationship among the "ink temperature," "printing actions," "heater actions," and the "driving signals" in a conventional print-execution procedure. The basic configurations of these charts are similar to those of FIGS. 7A and 7B, so that the description for the basic configurations of FIGS. 9A and 9B will not be given here. As FIG. 7A shows, the first embodiment is an example where the inkjet printer 100 interrupts the printing operation at the time t2, which is the predetermined time length Tm after the time t1. As FIG. 9A shows, the modified example of the first embodiment is an example where of the printing operation is completed at the time t2 which is earlier than the time t3 that is the predetermined time length Tm after the time t1. The flowchart for describing the print-execution procedure according to the modified example of the first embodiment is not given here. In FIG. 9A, the printing operation is started at the time t1 in which the ink temperature is equal to or higher than the second reference temperature, and completed at the time t2 which is earlier than the time t3 that is the predetermined time length Tm after the time t1 of the start of the printing operation. In the conventional printing processing, however, as FIG. 9B shows, printing is started only after the time t4, at which the ink temperature reaches the first reference temperature because of the greater influence of the increase in the mist production caused by the higher second voltage V2 of the driving signal than the ordinary first voltage V1. In addition, in the conventional printing processing, printing is completed at the time t5, which is later than the time t2. In this way, according to the modified example of the first embodiment, the inkjet printer 100, if used under a low-temperature environment, can start executing the printing earlier and complete the printing earlier than in the conventional cases while the mist production can be reduced.

Both in the above-described first embodiment and in the above-described modified example of the first embodiment, the inkjet printer 100 interrupts the printing operation on condition that the printing time has reached the predetermined time length Tm. This, however, is not the only possible printing-interruption condition for the invention. The inkjet printer 100 may interrupt the printing operation on condition, for example, that the number of prints has reached a predetermined number Nm. In this case, the print-job controller 210 includes, not the printing-time measuring unit 211, but, instead, a number-of-prints counter configured to count the number of prints done since the start of the printing operation. In addition, if the printing operation is executed with the low-temperature ink, the print-job controller 210 may interrupt the printing operation at the time when the number of prints that has been done reaches the predetermined number Nm. The idea can be understood easily by replacing the predetermined time Tm in each of FIGS. 7A, 8A, and 9A with the predetermined number of prints Nm. As described above, the printing with the low-temperature ink continues only until the inkjet printer 100 finishes printing the predetermined number Nm of sheets for the following reason. Along with the mist production, the mist thus produced is accumulated inside the printer chassis. Although the higher second voltage V2 increases the mist production, a single printing operation not including a large number of sheets does not cause very large amount of mist to be accumulated. Accordingly, a printing operation is considered allowable as long as the number of sheets to be printed in the single printing operation is within the predetermined number Nm. For this reason, the predetermined number of prints Nm may be determined in advance by way of an experiment, to be 100 sheets for example, by taking account of the amount of mist to be accumulated per a printing operation of a unit number of prints, the average coverage rate, the amount of mist accumulation or the number of prints that needs a maintenance work for the inside of the printer chassis. In addition, the inkjet printer 100 may interrupt the printing operation on condition that either the amount of the printed coverage that has been done or the amount of ink that has been used (since the start of the printing operation) has reached a predetermined amount Am. In this case, the print-job controller 210 includes, not the printing-time measuring unit 211, but, instead, a printed-coverage calculator configured to calculate the amount of printed coverage that has been done since the start of the printing operation, or an amount-of-ink-use calculator configured to calculate the amount of ink that has been used since the start of the printing operation. When the amount of printed coverage that has been done or the amount of ink that has been used reaches the predetermined amount Am while the printing on a particular sheet is being executed. So, and if the printing operation is executed with the low-temperature ink, the print-job controller 210 may interrupt the printing operation after the printing on the above-mentioned particular sheet is completed. The idea can be understood easily by replacing the predetermined time Tm in each of FIGS. 7A, 8A, and 9A with the predetermined amount Am. As described above, the printing with the low-temperature ink continues only until the amount of printed coverage that has been done or the amount of ink that has been used reaches the predetermined amount Am for a similar reason to the reason in the cases of the predetermined time length Tm and of the predetermined number of sheets to be printed Nm. The above-mentioned variables are not the only ones that can be used as the predetermined conditions for the interruption of the printing operation. Any variable can be used for the same purpose as long as the variable can suppress lowering of the print quality that may be caused by the ink ejection triggered by the driving signal of the higher second voltage V2.

Embodiment 2

Figure 11:
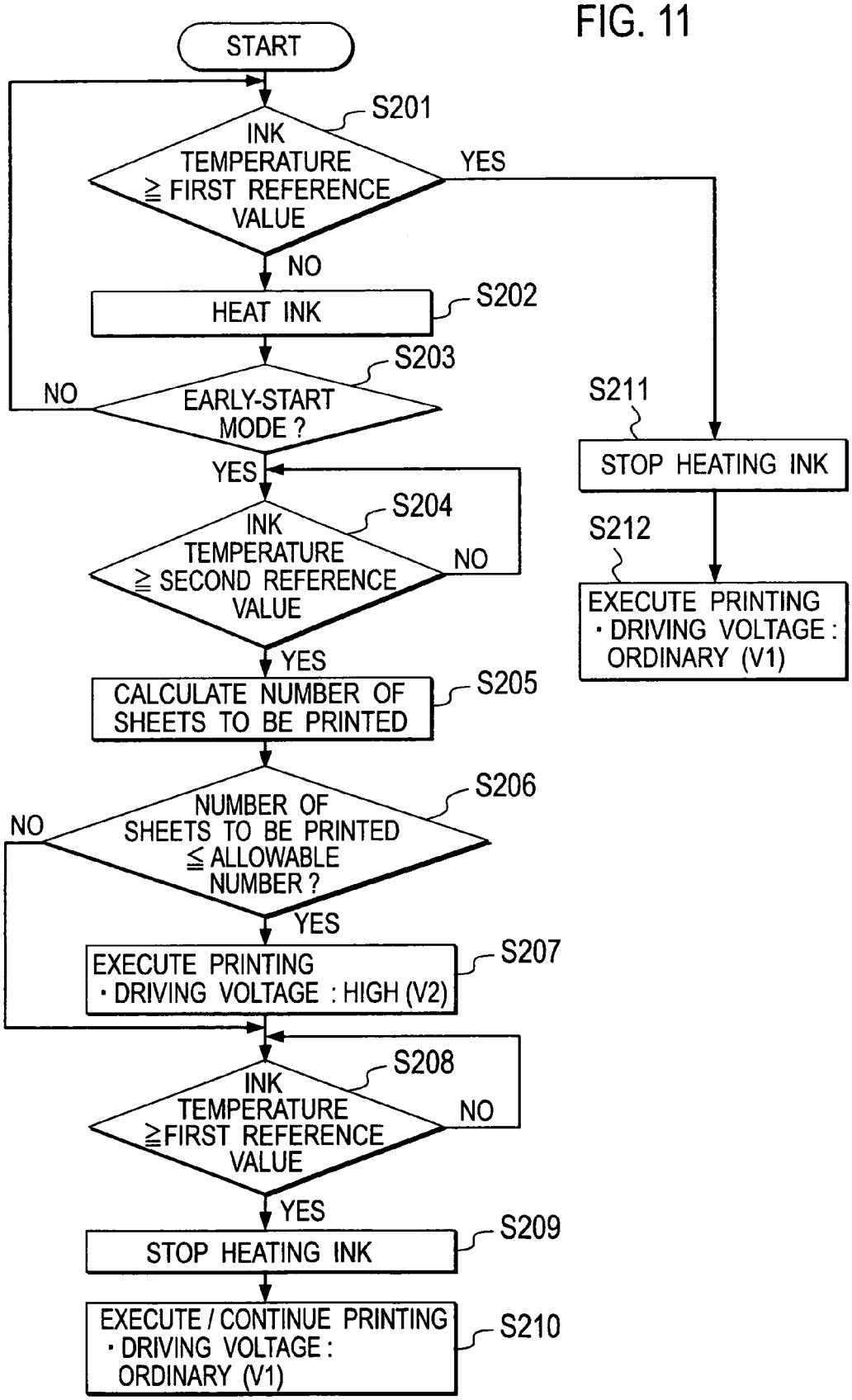
FIG. 11 is a flowchart for describing a print-execution procedure according to the second embodiment of the invention.

FIG. 11 is a flowchart illustrating a print-execution procedure according to the second embodiment of the invention. In the second embodiment, the printing execution under a low-temperature environment is controlled in terms of the print-start conditions that "the number of sheets to be printed is equal to or smaller than a predetermined allowable number."

Firstly, if the measured value of ink temperature is equal to or higher than the first reference temperature, e.g., 25° C., (S201: Yes), it is determined that the ink temperature is within the proper temperature range, and the ordinary printing processing is executed (S212). In this case, if the ink is being heated, the heating of ink is stopped (S211) before the execution of the printing processing. If the inks of different colors have different measured values of temperature from one another, the determination may be based, for example, on the average value of all the measured values of ink temperature, or on the lowest one of all the measured values of ink temperature. In the ordinary printing processing, each driver 132 outputs to the corresponding piezoelectric elements 136 the driving signal that has the ordinary first voltage V1 that is high enough to secure a proper ejection amount of ink while the ink temperature is within the proper temperature range.

In contrast, if the measured value of ink temperature is lower than the first reference temperature, e.g., 25° C., (S201: No), the ink-temperature adjuster 260 activates the heater 140 to heat the ink (S202) until the ink temperature is raised up to a proper temperature.

If the user does not instruct the inkjet printer 100 to execute earlier print start with low-temperature ink (S203: No), the inkjet printer 100 does not start executing the printing processing but waits until the measured value of ink temperature reaches the first reference temperature or higher. When the measured value of ink temperature reaches the first reference temperature or higher (S201: Yes), the heating of the ink is stopped (S211), and the ordinary printing processing is executed (S212).

If the user wants the inkjet printer 100 to execute the earlier print start with low-temperature ink, the user may set, for example, the execution of the earlier print start on the printer driver, through which instructions for the printing are given. Alternatively, the user may set the execution of the earlier print start using the operation panel 400 of the inkjet printer 100. Still alternatively, the administrator may set default as to whether or not the earlier print start is to be executed.

If the user instructs the inkjet printer 100 to execute earlier print start with low-temperature ink (S203: Yes), whether or not the measured value of ink temperature is equal to or above the second reference temperature, e.g., 20° C., is determined (S204). If the measured value of the ink temperature is lower than the second reference temperature (S204: No), the inkjet printer 100 waits until the measured value of ink temperature reaches the second reference temperature or higher. This is because the viscosity of the ink of a lower temperature than the second reference temperature is so large that even the driving signal of a higher voltage cannot secure the proper amount of ink ejection. To put it differently, the second reference temperature is determined at a temperature that prevents the driving signal of the larger voltage from providing the proper amount of ink ejection.

If the measured value of the ink temperature is equal to or higher than the second reference temperature (S204: Yes), the number-of-prints calculator 212 calculates the number of printing sheets to be printed in the print job of the processing target (S205). If the number of printing sheets to be printed is equal to or smaller than the predetermined allowable number Nm (S206: Yes), the inkjet printer 100 executes the printing processing (S207). To secure the proper amount of ink ejection, the driving signal that has the higher second voltage V2 than the ordinary first voltage V1 is outputted to the piezoelectric elements 136 (S207).

In this way, even with the low-temperature ink, the proper amount of ink ejection can be secured. The higher second voltage V2, however, increases the ink-ejection speed and thus the mist production, as well. In the second embodiment, to reduce the influence of the increase in mist production, the printing operation of a print job is executed as far as the number of printing sheet to be printed in the print job is equal to or smaller than the allowable number Nm.

The print job to be executed with the low-temperature ink is only a print job in which the number of printing sheet to be printed is equal to or smaller than the allowable number Nm for the following reason. Along with the mist production, the mist thus produced is accumulated inside the printer chassis. Although a higher driving voltage increases the mist production, a single print job in which not a large number of printing sheets are to be printed does not cause very large amount of mist to be accumulated. Accordingly, a printing operation is considered to be allowable if the number of printing sheet to be printed in the printing operation is equal to or smaller than the predetermined number. For this reason, the allowable number of printing sheets Nm may be determined in advance by way of an experiment, to be 100 sheets for example, by taking account of the amount of mist to be accumulated by a single print job of a unit number of printing sheet to be printed, the average coverage rate, the amount of mist accumulation or the number of prints that needs a maintenance work for the inside of the printer chassis.

After that, once the measured value of ink temperature reaches the first reference temperature or higher (S208: Yes), the heating of the ink is stopped (S209). Then, if the printing operation with a driving signal of the larger second voltage V2 than the ordinary first voltage V1 has been executed, the printing conditions are changed to those for the printing by the driving signal of an ordinary first voltage V1, and the execution of the printing operation is continued (S210). Since the printing operation is executed by the driving signal of the ordinary first voltage V1, the mist production in this printing operation is not as large as the mist production in the printing operation executed by the driving signal of the higher second voltage V2. If the number of printing sheets to be printed in the print job is larger than the allowable number Nm and no printing operation is currently being executed, the execution of the printing operation for the print job is started by a driving signal of the ordinary first voltage V1 (S210).

Figure 12A:
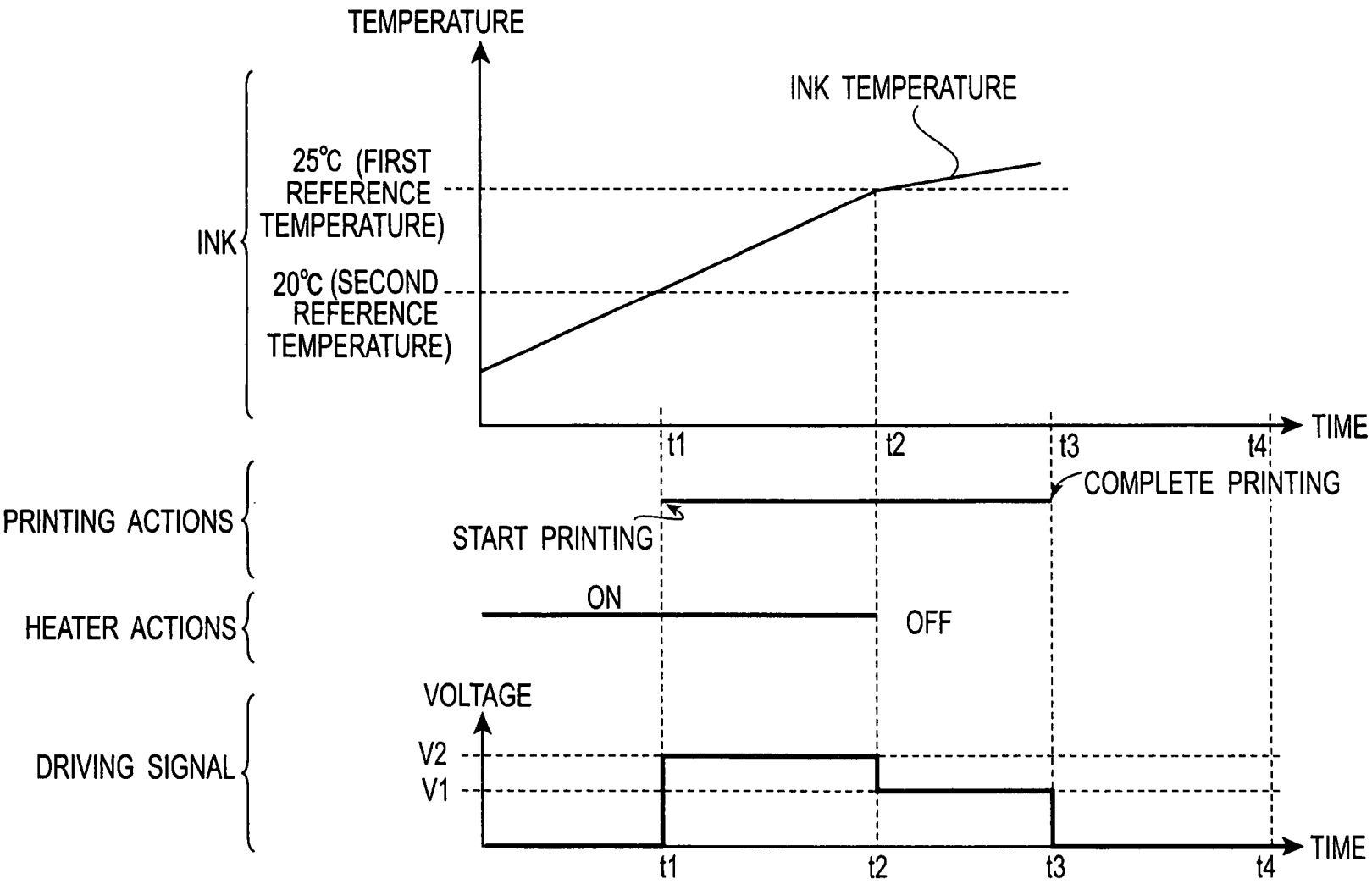
FIG. 12A is a chart illustrating the relationship among the ink temperature, printing actions, and the like in the print-execution procedure according to the second embodiment of the invention.
Figure 12B:
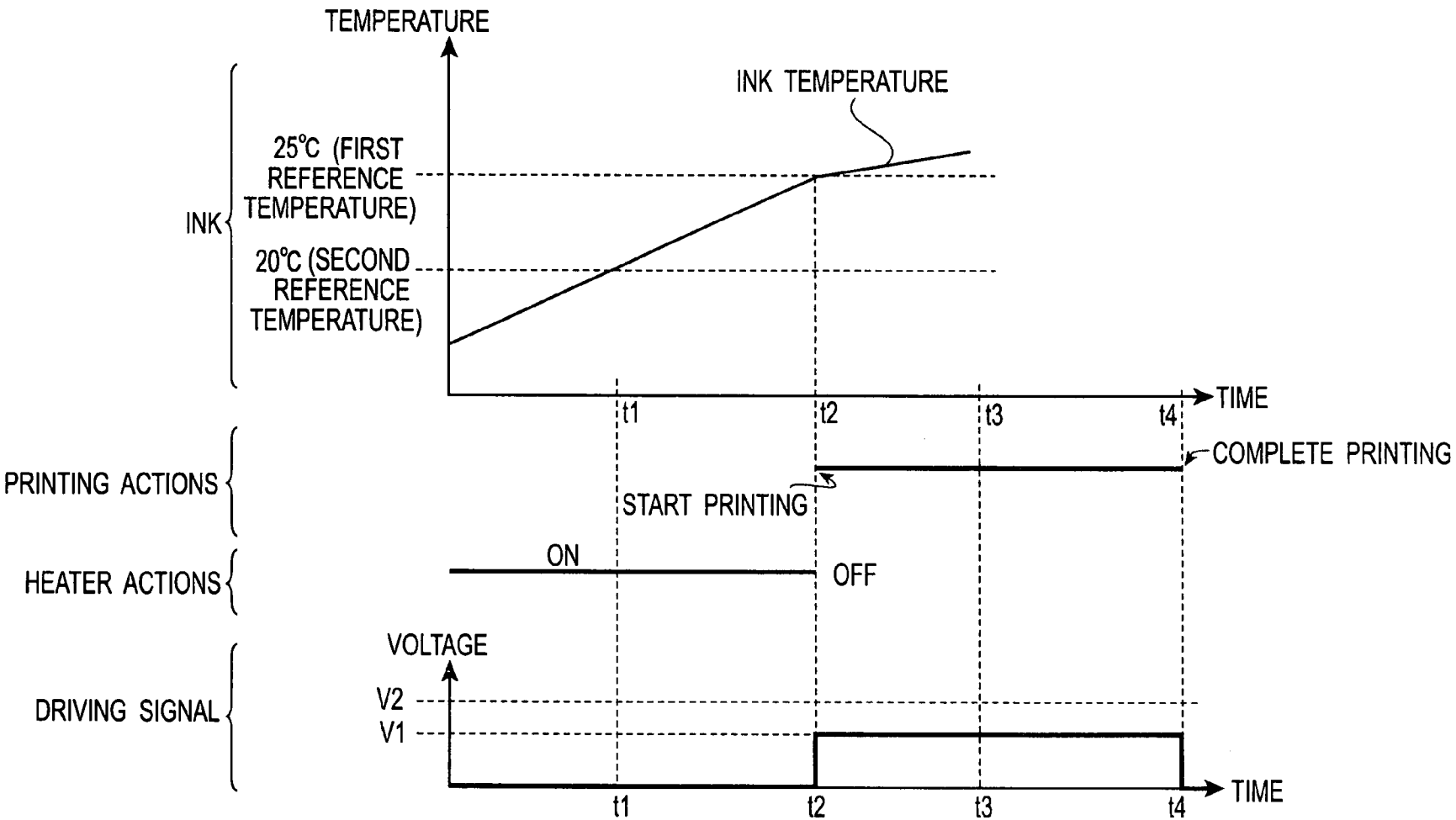
FIG. 12B is a chart corresponding to FIG. 12A and illustrating the relationship among the ink temperature, printing actions, and the like in a conventional print-execution procedure.

FIG. 12A is a chart illustrating the relationship among the "ink temperature," "printing actions," "heater actions," and the "driving signals" in the print-execution procedure according to the second embodiment of the invention. FIG. 12B is a chart corresponding to FIG. 12A and illustrating the relationship among the "ink temperature," "printing actions," "heater actions," and the "driving signals" in a conventional print-execution procedure. The basic configurations of these charts are similar to those of FIGS. 7A and 7B, so that the description for the basic configurations of FIGS. 12A and 12B will not be given here.

In the above-mentioned printing actions of the second embodiment, as FIG. 12A shows, if the number of printing sheets to be printed in the print job is equal to or smaller than the allowable number Nm, and the measured value of ink temperature is lower than the second reference temperature, the heater 140 is activated to heat the ink, and thereby the inkjet printer 100 can start executing the printing operation at the time t1, at which the ink temperature reaches the second reference temperature. In addition, at the time t3 the inkjet printer 100 completes the printing operation. In the conventional printing processing, however, as FIG. 12B shows, the printing is started only after the time t2, at which the ink temperature reaches the first reference temperature because of the greater influence of the increase in the mist production caused by the higher second voltage V2 of the driving signal than the ordinary first voltage V1. In addition, in the conventional printing processing, the printing is completed at the time t4, which is later than the time t3. In the second embodiment, the influence of the increase in the mist production is reduced by executing a print job in which the number of the printing sheets to be printed is equal to the allowable number Nm at the maximum. Consequently, according to the second embodiment, the inkjet printer 100, if used under a low-temperature environment, can start executing the printing earlier and complete the printing earlier than in the conventional cases while the influence caused by the mist production can be reduced.

Modified Example 1 of Embodiment 2

Figure 13A:
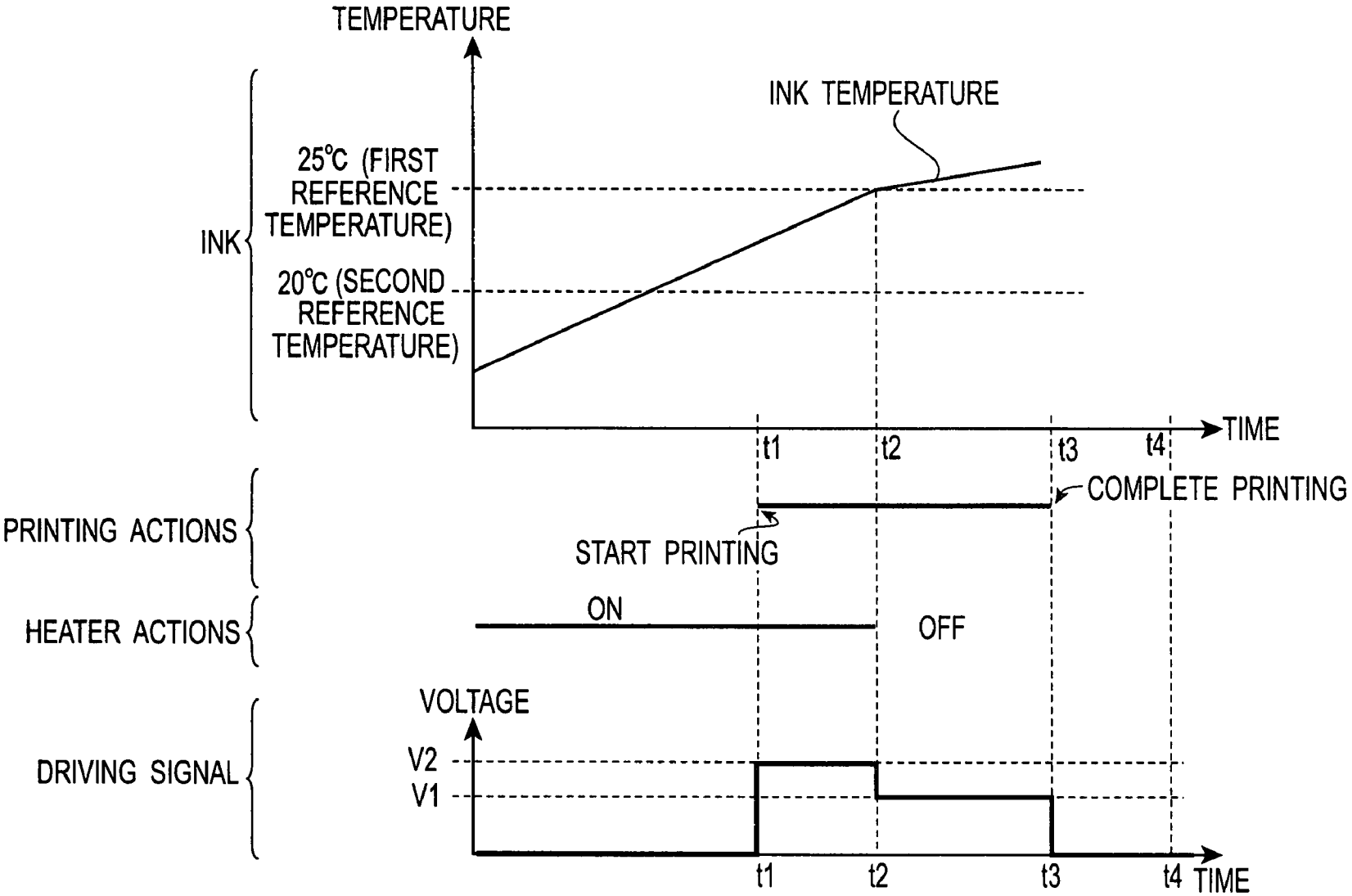
FIG. 13A is a chart illustrating the relationship among the ink temperature, printing actions, and the like in the print-execution procedure according to a first modified example of the second embodiment of the invention.
Figure 13B:
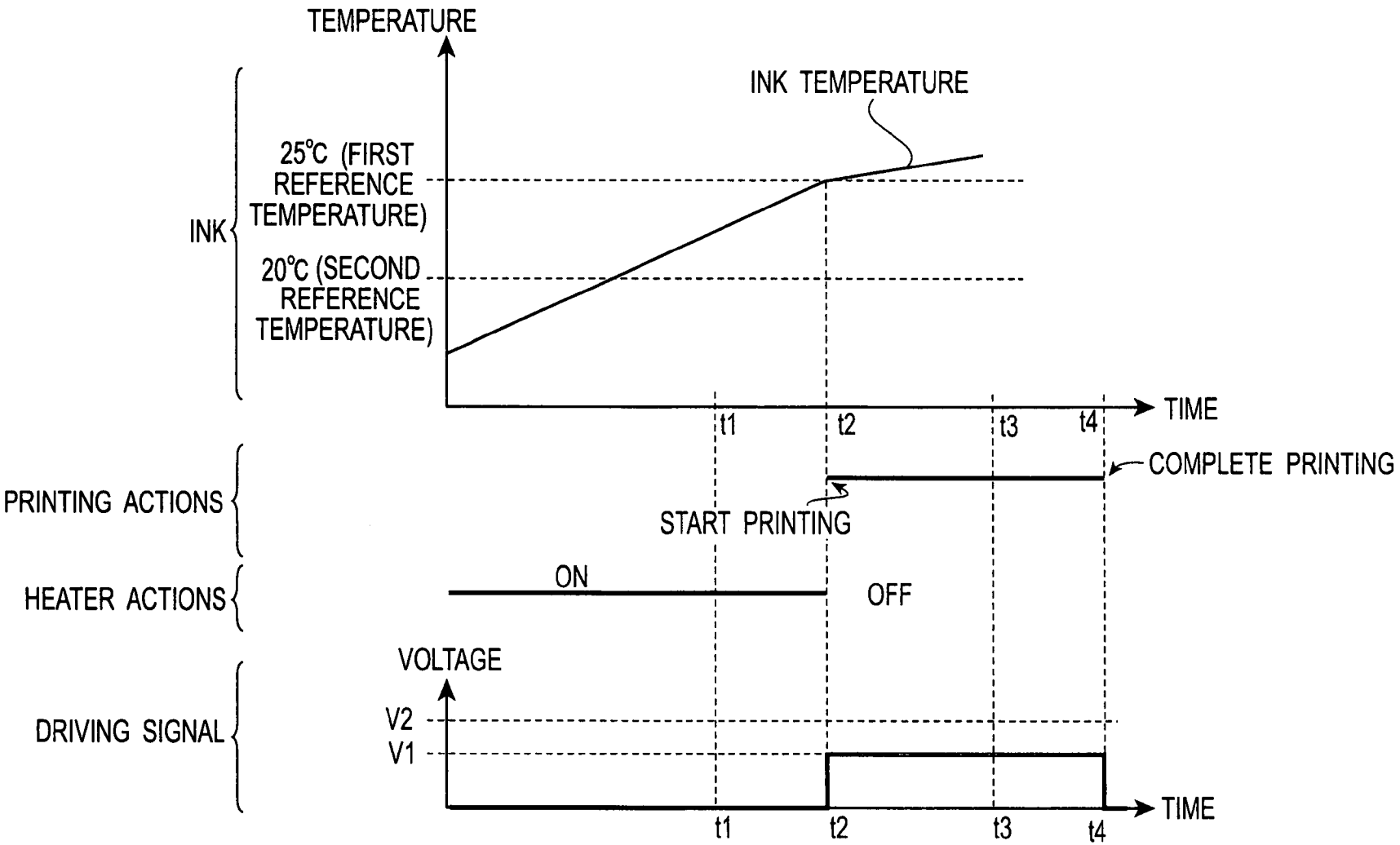
FIG. 13B is a chart corresponding to FIG. 13A and illustrating the relationship among the ink temperature, printing actions, and the like in a conventional print-execution procedure.

FIG. 13A is a chart illustrating the relationship among the "ink temperature," "printing actions "heater actions," and the "driving signals" in the print-execution procedure according to an modified example 1 of the second embodiment of the invention. FIG. 13B is a chart corresponding to FIG. 13A and illustrating the relationship among the "ink temperature," "printing actions," "heater actions," and the "driving signals" in a conventional print-execution procedure. The basic configurations of these charts are similar to those of FIGS. 7A and 7B, so that the description for the basic configurations of FIGS. 13A and 13B will not be given here. As FIG. 12A shows, the second embodiment is an example where the inkjet printer 100 starts executing the printing operation at the time t1, at which the ink temperature is the second reference temperature, and where the inkjet printer 100 completes the printing operation at the time t3. As FIG. 13A shows, the modified example 1 of the second embodiment is an example where the inkjet printer 100 starts executing the printing operation at the time t1, at which the ink temperature reaches the second reference temperature, and where the inkjet printer 100 completes the printing operation at the time t3. The flowchart for describing the print-execution procedure according to the modified example 1 of the second embodiment is not given here. In FIG. 13A, the printing operation is started at the time t1, at which the ink temperature reaches the second reference temperature, and the printing operation is completed at the time t3. In the conventional printing processing, however, as FIG. 13B shows, the printing is started only after the time t2, at which the ink temperature reaches the first reference temperature because of the greater influence of the increase in the mist production caused by the higher second voltage V2 of the driving signal than the ordinary first voltage V1. In addition, in the conventional printing processing, the printing is completed at the time t4, which is later than the time t3. In this way, according to the modified example 1 of the second embodiment, the inkjet printer 100, if used under a low-temperature environment, can start executing the printing earlier and complete the printing earlier than in the conventional cases while the mist production can be reduced.

Modified Example 2 of Embodiment 2

Figure 14A:
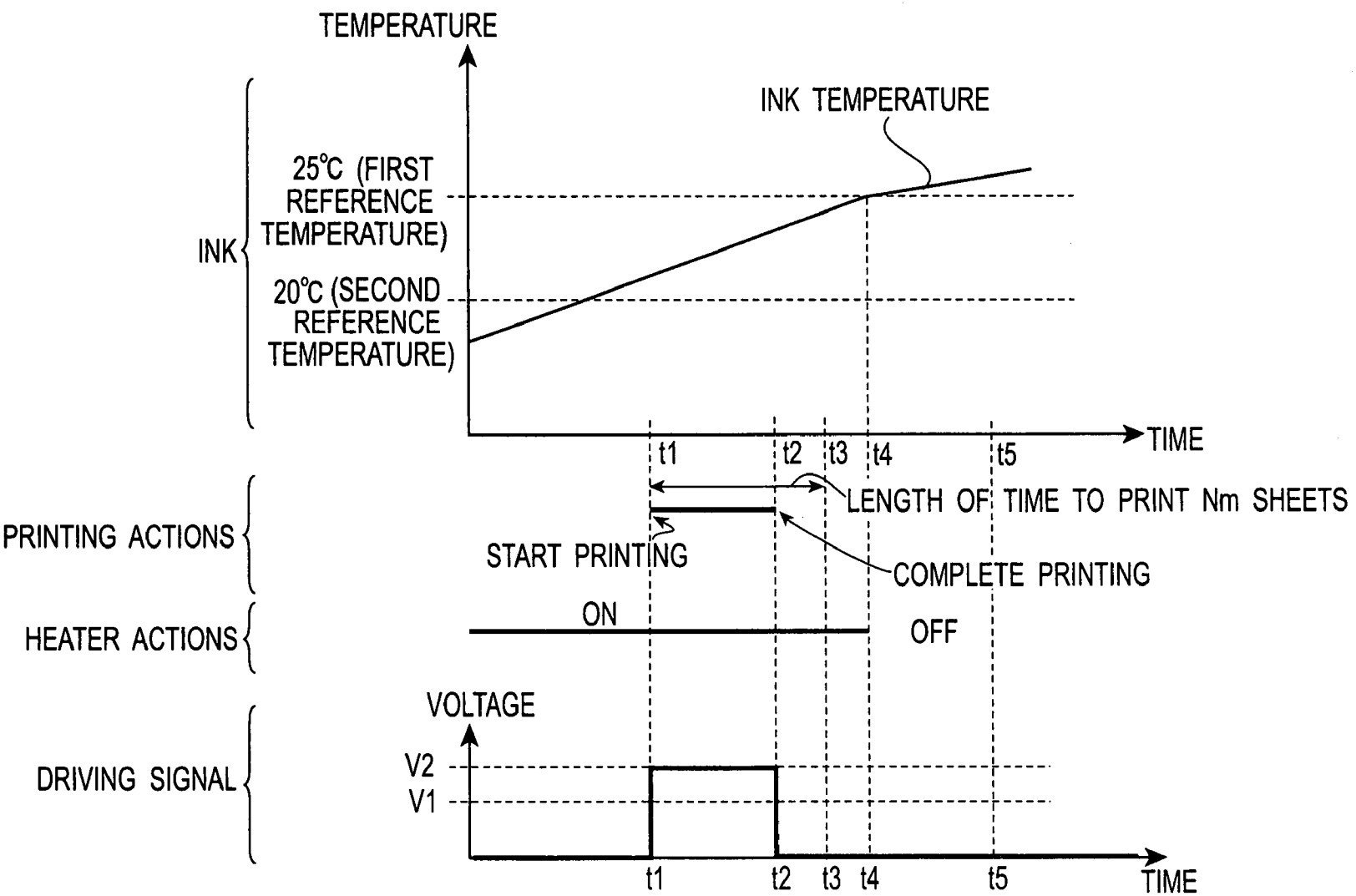
FIG. 14A is a chart illustrating the relationship among the ink temperature, printing actions, and the like in the print-execution procedure according to a second modified example of the second embodiment of the invention.
Figure 14B:
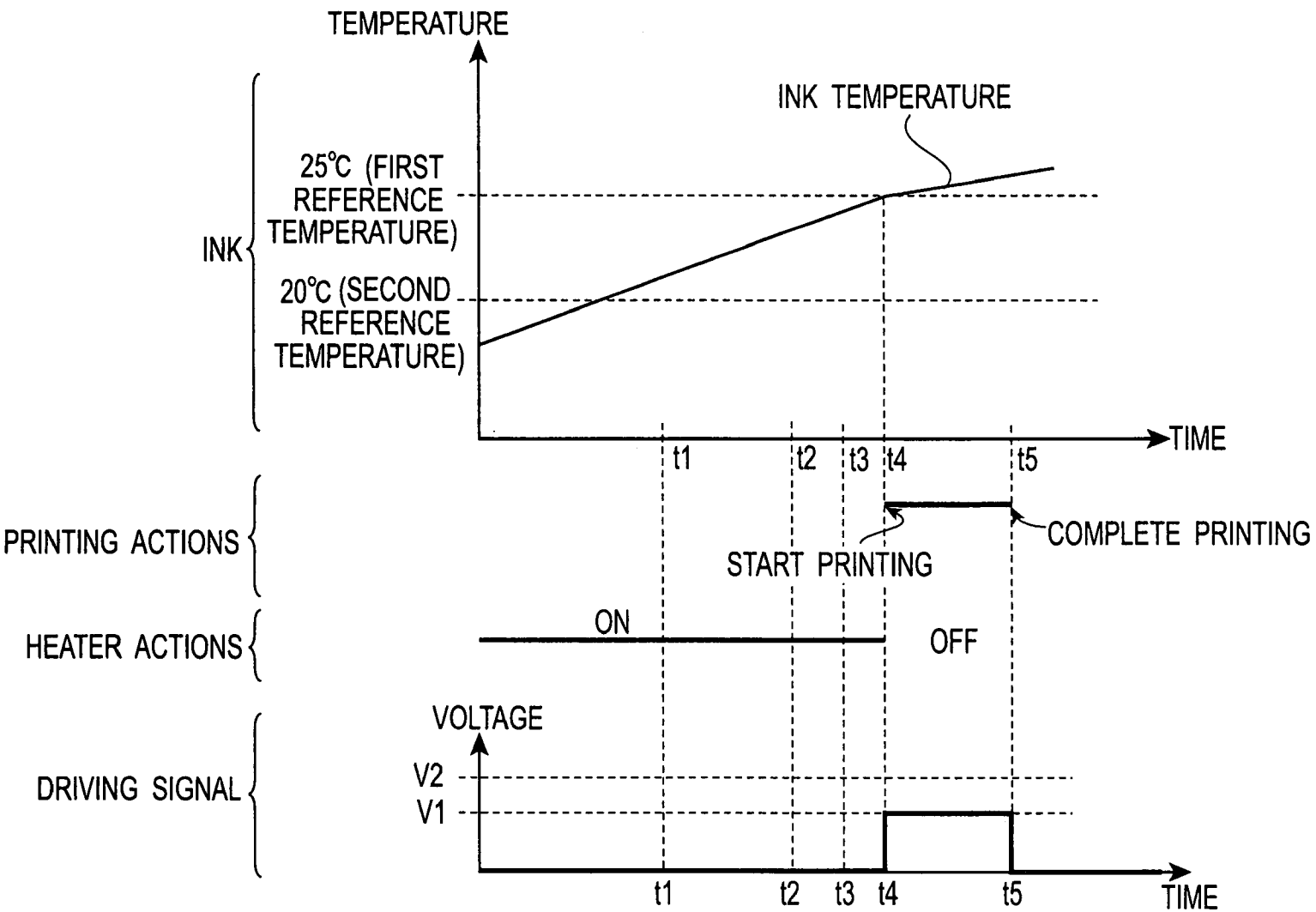
FIG. 14B is a chart corresponding to FIG. 14A and illustrating the relationship among the ink temperature, printing actions, and the like in a conventional print-execution procedure.

FIG. 14A is a chart illustrating the relationship among the "ink temperature," "printing actions "heater actions," and the "driving signals" in the print-execution procedure according to an modified example 2 of the second embodiment of the invention. FIG. 14B is a chart corresponding to FIG. 14A and illustrating the relationship among the "ink temperature," "printing actions," "heater actions," and the "driving signals" in a conventional print-execution procedure. The basic configurations of these charts are similar to those of FIGS. 7A and 7B, so that the description for the basic configurations of FIGS. 14A and 14B will not be given here. As FIG. 12A shows, the second embodiment is an example where the inkjet printer 100 starts executing the printing operation at the time t1 and where the inkjet printer 100 completes the printing operation at the time t3 which is later than the time t2, at which the ink temperature reaches the first reference temperature. As FIG. 14A shows, the modified example 2 of the second embodiment is an example where the inkjet printer 100 starts executing the printing operation at the time t1, and where the inkjet printer 100 completes the printing operation at the time t2 which is earlier than the time t3, at which the inkjet printer 100 is supposed to complete the printing operation for the allowable number of printing sheets Nm and which is also earlier than the time t4, at which the ink temperature reaches the first reference temperature. The flowchart for describing the print-execution procedure according to the modified example 2 of the second embodiment is not given here. In FIG. 14A, the printing operation is started at the time t1, at which the ink temperature reaches the second reference temperature, and the printing operation is completed at the time t2, which is earlier than the time t3 at which the printing operation, started at the time t1, for the allowable number of printing sheets Nm is supposed to be completed. In the conventional printing processing, however, as FIG. 14B shows, the printing is started only after the time t4, at which the ink temperature reaches the first reference temperature because of the greater influence of the increase in the mist production caused by the higher second voltage V2 of the driving signal than the ordinary first voltage V1. In addition, in the conventional printing processing, the printing is completed at the time t5, which is later than the time t2. In this way, according to the modified example 2 of the second embodiment, the inkjet printer 100, if used under a low-temperature environment, can start executing the printing earlier and complete the printing earlier than in the conventional cases while the mist production can be reduced.

Embodiment 3

Figure 16:
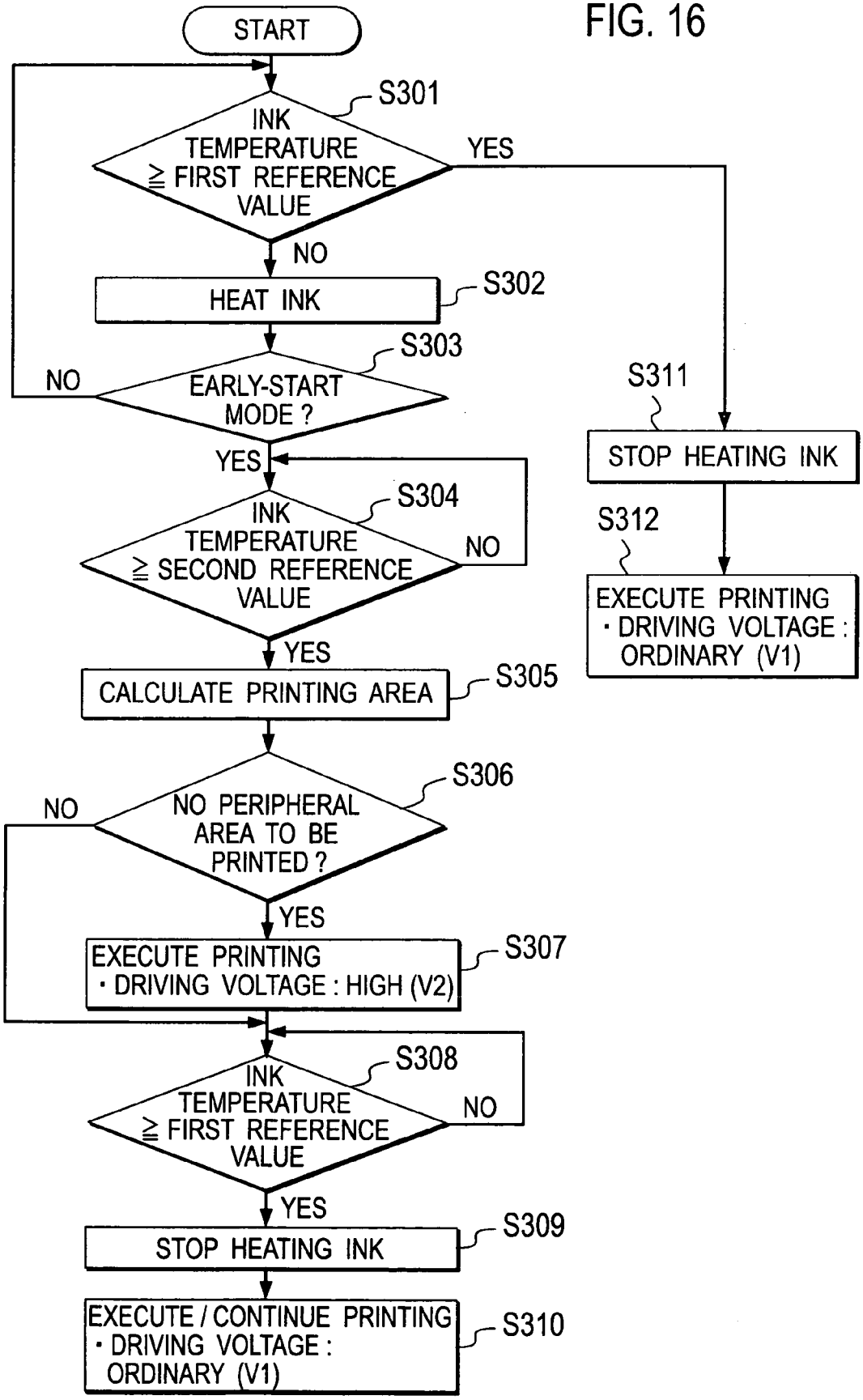
FIG. 16 is a flowchart for describing a print-execution procedure according to the third embodiment of the invention.

FIG. 16 is a flowchart illustrating a print-execution procedure according to the third embodiment of the invention. In the third embodiment, the printing execution under a low-temperature environment is controlled in terms of the print-start conditions that "the printing area does not include a predetermined area located in the peripheral portions of the printing sheet."

Firstly, if the measured value of ink temperature is equal to or higher than the first reference temperature, e.g., 25° C., (S301: Yes), it is determined that the ink temperature is within the proper temperature range, and the ordinary printing processing is executed (S312). In this case, if the ink is being heated, the heating of ink is stopped (S311) before the execution of the printing processing. If the inks of different colors have different measured values of temperature from one another, the determination may be based, for example, on the average value of all the measured values of ink temperature, or on the lowest one of all the measured values of ink temperature. In the ordinary printing processing, each driver 132 outputs to the corresponding piezoelectric elements 136 the driving signal that has the ordinary first voltage V1 that is high enough to secure a proper ejection amount of ink while the ink temperature is within the proper temperature range.

In contrast, if the measured value of ink temperature is lower than the first reference temperature, e.g., 25° C., (S301: No), the ink-temperature adjuster 260 activates the heater 140 to heat the ink (S302) until the ink temperature is raised up to a proper temperature.

If the user does not instruct the inkjet printer 100 to execute earlier print start with low-temperature ink (S303: No), the inkjet printer 100 does not start executing the printing processing but waits until the measured value of ink temperature reaches the first reference temperature or higher. When the measured value of ink temperature reaches the first reference temperature or higher (S301: Yes), the heating of the ink is stopped (S311), and the ordinary printing processing is executed (S312).

If the user instructs the inkjet printer 100 to execute earlier print start with low-temperature ink (S303: Yes), whether or not the measured value of ink temperature is equal to or above the second reference temperature, e.g., 20° C., is determined (S304). If the measured value of the ink temperature is lower than the second reference temperature (S304: No), the inkjet printer 100 waits until the measured value of ink temperature reaches the second reference temperature or higher.

If the measured value of the ink temperature is equal to or higher than the second reference temperature (S304: Yes), the area of the printing sheet in which images are formed in the print job of the processing target is calculated (S305). If the printing area does not include the predetermined area located in the peripheral portions of the printing area (S306: Yes), the inkjet printer 100 executes the printing processing (S307). If the print job includes plural pages to be printed, the printing process is executed as far as none of the printing sheets for all the pages has the printing area including the predetermined area located in the peripheral portions of the printing sheet. To secure the proper amount of ink ejection, the driving signal that has the higher second voltage V2 than the ordinary first voltage V1 is outputted to the piezoelectric elements 136 (S307).

Figure 17:
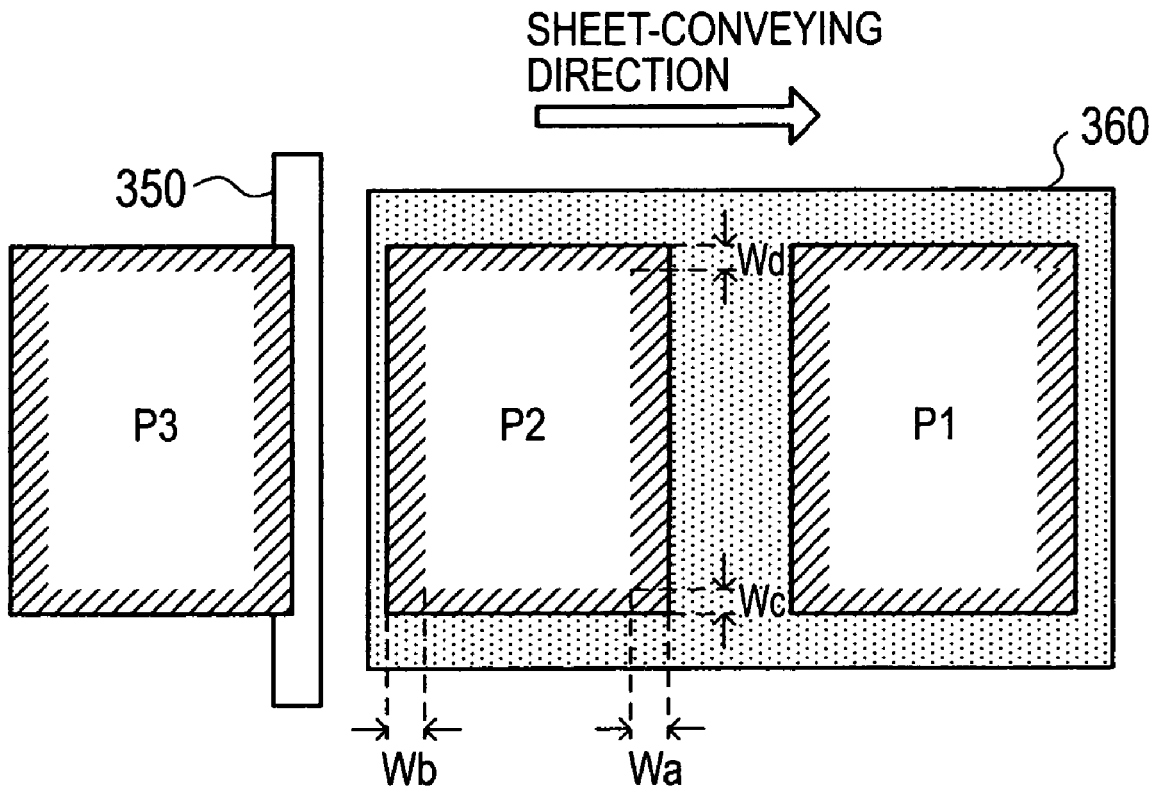
FIG. 17 is a diagram illustrating how a conveyor belt conveys printing sheets.

The print job to be executed with the low-temperature ink is only a print job in which the printing area does not include the predetermined area located in the peripheral portions of the printing sheet for the following reason. As FIG. 17 shows, the printing sheet is conveyed by the conveyor belt 360. The printing on printing sheets P1, P2, and P3 is executed in this sequence. In the state shown in FIG. 17, the register rollers 350 stop, temporarily, the printing sheet P3, and convey the printing sheet P3 towards the conveyor belt 360 at a timing that makes the interval between the printing sheets P2 and P3 appropriate.

Figure 18:
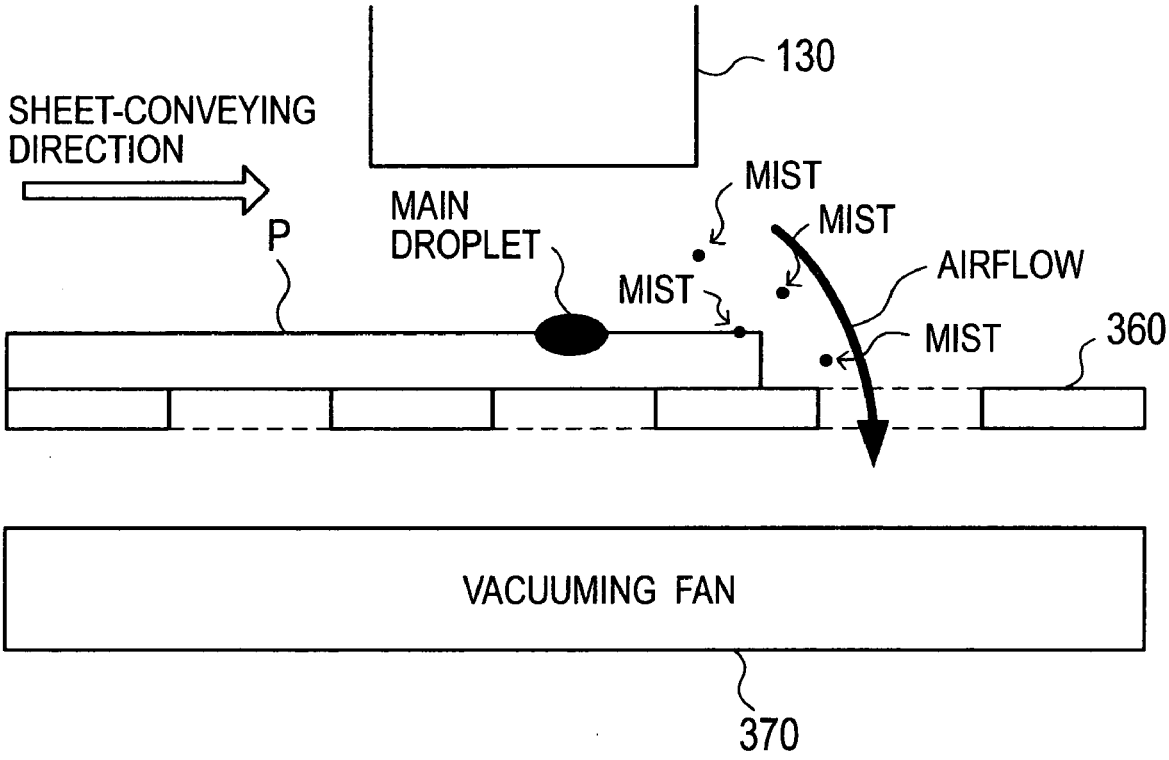
FIG. 18 is a diagram for describing an airflow caused by a vacuuming fan.

As described above, multiple ventilation holes are formed in the surface of the conveyor belt 360. The vacuuming fan 370 generates airflow and thereby the sucking force as well. The sucking force makes the printing sheet adhere to the conveyor belt 360. In an area having no printing sheet, the air flows from the inkjet head 130, passes through the ventilation holes, and then is led towards the vacuuming fan 370 as FIG. 18 shows. Accordingly, airflow towards the outer sides of the printing sheet is formed around the printing sheet.

The mist produced in the inkjet head 130 is carried by the airflow and flies about over the peripheral portions of the printing sheet more densely than the rest of the printing sheet. Accordingly, the influence of the mist is more noticeable in the peripheral portions of the printing sheet than the rest of the printing sheet. In addition, the printing sheet, if conveyed at a high speed, produces airflow that flows in the conveying direction of the printing sheet. Accordingly, within the printing sheet, the mist becomes more noticeable in the end portions in the conveying direction of the printing sheet.

Consequently, if the printing area does not include the predetermined area located in the peripheral portions of the printing sheet, the amount of mist produced over the peripheral portions of the printing sheet is reduced. Thereby, the amount of mist led to the peripheral portions of the printing sheet is also reduced. Thus, the influence of mist can probably be reduced.

The predetermined area located in the peripheral portions has four parts respectively having the widths Wa, Wb, Wc, and Wd (shown in FIG. 17). These widths may be determined, in advance, through an experiment or the like so that the influence of mist can be less noticeable. When the widths are determined, the airflow generated in the conveying direction of the printing sheet (i.e., the direction indicated by the arrow in FIG. 17) may be taken into account. If the predetermined area located in the peripheral portions of the printing sheet is determined by taking account of the airflow in the conveying direction of the printing sheet, the widths of the peripheral portions located in the end portions in the conveying direction of the printing sheet (i.e., the widths Wa and Wb) are wider than the widths of the peripheral portions in the end portions in a direction crossing the conveying direction of the printing sheet (i.e., the widths Wc and Wd).

After that, when the measured value of ink temperature reaches the first reference temperature or higher (S308: Yes), the heating of the ink is stopped (S309). Then, if the printing operation with a driving signal of the larger second voltage V2 than the ordinary first voltage V1 is being executed, the driving signal of the larger second voltage V2 is replaced with the driving signal of the ordinary first voltage V1, and then the printing operation is continued (S310). This printing operation is executed by the driving signal of the ordinary first voltage V1, so that the mist production in this printing operation is not as much as the mist production in the case of the printing operation executed by the driving signal of the larger second voltage V2. If the printing area includes the predetermined area located in the peripheral portions of the printing sheet and, accordingly, no printing operation is being executed, the inkjet printer 100 starts executing the printing operation with the driving signal of the ordinary first voltage V1 (S310). In this way, according to the third embodiment, as in the case of the second embodiment, the inkjet printer 100, if used under a low-temperature environment, can start executing the printing earlier than in the conventional cases while the influence caused by the mist can be reduced.

Modified Examples 1 and 2 of Embodiment 3

The third embodiment can be modified (i.e., a first modified example and a second modified example of the third embodiment can be conceived) in the similar manners to the case of the modified examples 1 and 2 of the second embodiment.

Modified Example 3 of Embodiment 2 and of Embodiment 3

Figure 19:
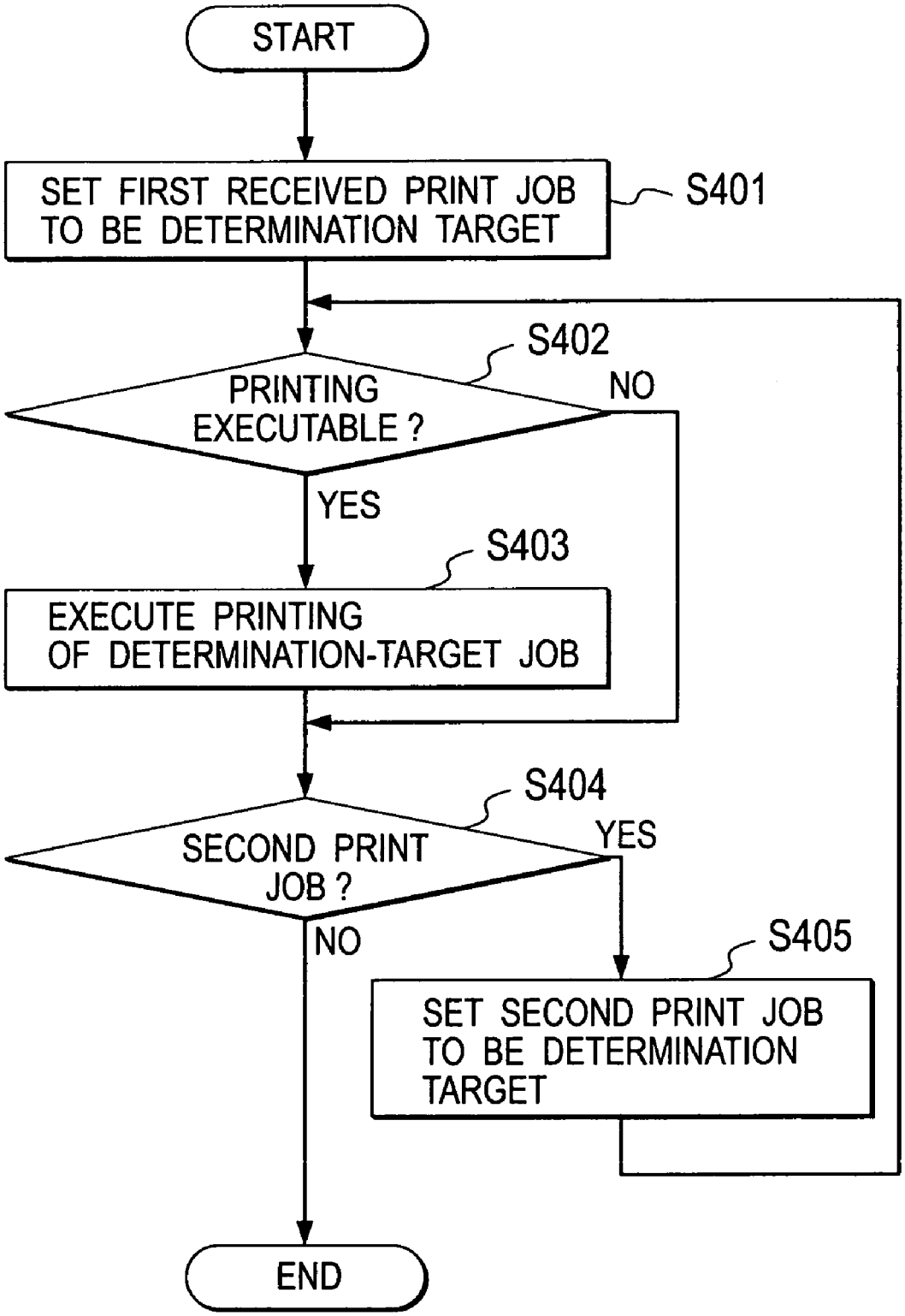
FIG. 19 is a flowchart for describing a print-execution procedure according to a third modified example of the second embodiment of the invention and a third modified example of the third embodiment of the invention.

As a modified example 3 of the second embodiment and of the third embodiment, processing in the case where the inkjet printer 100 receives plural print jobs will be described below by referring to the flowchart of FIG. 19. Print jobs are usually processed in the sequence of being received by the inkjet printer 100. So, if the print job received first does not satisfy the conditions for the execution of the printing operation with the low-temperature ink, the inkjet printer 100 cannot start executing the printing operation for the subsequent print jobs until the ink temperature reaches the first reference temperature, even though at least one of the subsequent print jobs satisfies the conditions for the execution of the printing operation. To address this problem, in the modified example 3 of the second embodiment and of the third embodiment, the following processing is executed.

Firstly, the print-execution determiner 214 of each of the print-job controllers 210X and 210Y picks up the print job that has been received first as the determination target (S401). Then, the print-execution determiner 214 determines whether or not the first print job of the determination target is executable in accordance with the determination criterion of either the second embodiment or the third embodiment (S402). Specifically, if the determination criterion of the second embodiment is used, the determination as to whether or not the number of sheets to be printed is equal to the allowable number Nm at the maximum. If the determination criterion of the third embodiment is used, the determination as to whether or not the printing area includes the predetermined area located in the peripheral portions of the printing sheet.

If it is determined that the first print job is executable (S402: Yes), the print job of the determination target is executed (S403). Conversely, if it is determined that the first print job is not executable (S402: No), the first print job is not executed.

Then, if the subsequent print job has been received (S404: Yes), the print-execution determiner 214 picks up the received second print job as the determination target (S405), and determines whether or not the printing operation for the second print job is executable (S402). If it is determined that the printing operation for second print job is executable (S402: Yes) the printing operation for the print job of the determination target is executed (S403).

By repeating the above-described processing, as far as the printing operation for a print job is executable, the printing operation for the print job is executed preferentially prior to the different print job which had been received before the above-mentioned print job and for which the printing operation is not executable. With the control in this manner, the inkjet printer 100 can achieve a shorter print-start waiting time for the entire print jobs, and can shorten the time length that it takes for the inkjet printer 100 to complete the printing operation for the entire print jobs. For example, even in a case where the print job that has been received first does not satisfy the conditions for executing the printing operation with the low-temperature ink, the printing operation for one of the subsequent print jobs can be started as far as the printing operation for the subsequent print job is executable with the ink temperature being equal to or higher than the second reference temperature that is lower than the first reference temperature. Note that the modified example 3 of the second embodiment and of the third embodiment can be combined with either the modified example 1 or the modified example 2 of the corresponding one of the second and the third embodiments.

In the second embodiment, and in the modified examples 1 to 3 of the second embodiment, the inkjet printer 100 starts executing a printing operation on condition that the number of printing sheets to be printed is equal to or smaller than the allowable number Nm. The above-mentioned conditions for starting printing operation are not the only possible conditions. Alternatively, for example, the inkjet printer 100 may start executing a printing operation on condition that the time length needed for completing the printing of the number of printing sheets included in the print job of the processing target is equal to or shorter than the predetermined allowable time Tm. In this case, the print-job controller 210X may include a printing-time calculator instead of the number-of-prints calculator 212. The printing-time calculator calculates the time length needed for completing the printing of the number of printing sheets to be printed in the print job of the processing target on the basis, for example, of the printing time needed for executing the printing of a unit number of printing sheets. If the calculated time length needed for the printing operation is equal to or shorter than the predetermined allowable time length Tm, the print-job controller 210X executes the printing processing. Here, the print job to be executed with the low-temperature ink is the print job that it takes the predetermined allowable time Tm or shorter for the inkjet printer 100 to complete the printing operation including the number of prints in the print job for the following reason. Along with the mist production, the mist thus produced is accumulated inside the printer chassis. Although the higher driving voltage increases the mist production, a single print job that does not need a long time to be completed does not cause very large amount of mist to be accumulated. Accordingly, a printing operation lasting for the predetermined allowable time Tm at the maximum is considered to be allowable. For this reason, the predetermined allowable time Tm may be determined in advance by way of an experiment, to be 5 minutes for example, by taking account of the amount of mist to be accumulated per a single print job, the average coverage rate, the amount of mist accumulation or the number of prints that needs a maintenance work for the inside of the printer chassis. In addition, the inkjet printer 100 may start executing the printing operation on condition that either the amount of the printed coverage that has been done or the amount of ink that has been used of the print job of the processing target has reached a predetermined amount Am. In this case, the print-job controller 210X includes, not the number-of-prints calculator 212, but, instead, a printed-coverage calculator configured to calculate the amount of printed coverage that is needed for printing the print job of the processing target, or an amount-of-ink-use calculator configured to calculate the amount of ink needed for printing the print job of the processing target. If the calculated amount of printed-coverage or the calculated amount of the used ink is equal to or smaller than the predetermined amount Am, the print-job controller 210X executes the printing processing. The print jobs to be executed with the low-temperature ink are limited to the print jobs requiring the amount of printed coverage or the amount of the used ink which is equal to or smaller than the predetermined amount Am for a similar reason to those in the case of the predetermined allowable number of sheets Nm and in the case of the predetermined allowable time Tm. The above-mentioned variables are not the only ones that can be used as the predetermined conditions. Any variable can be used for the same purpose as long as the variable can suppress lowering of the print quality that may be caused by the ink ejection triggered by the driving signal of the higher second voltage V2.

The inkjet image-forming apparatus and the method for printing according to the embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiment of the present invention are only a list of optimum effects achieved by the present invention. Hence, the effects of the present invention are not limited to those described in the embodiment of the present invention.

What is claimed is:

1. An image forming apparatus comprising:

a print-job controller configured to receive a print job and control a printing operation based on the received print job;

an ink-ejection driver configured to output a driving signal on the basis of the print job;

an ink ejector configured to eject ink onto a paper sheet on the basis of the driving signal outputted by the ink-ejection driver; and an ink-temperature measuring unit configured to measure an ink temperature, wherein when the ink temperature measured by the ink-temperature measuring unit is equal to or higher than a first reference temperature, the ink-ejection driver outputs a driving signal of a first voltage, and wherein when the ink temperature measured by the ink-temperature measuring unit is lower than the first reference temperature and is equal to or higher than a second reference temperature that is lower than the first reference temperature, the print-job controller performs the printing operation as long as predetermined conditions are satisfied for suppressing lowering of print quality possibly caused by ink ejection based on a driving signal of a second voltage that is higher than the first voltage, and the ink-ejection driver outputs the driving signal of the second voltage while the printing operation is being performed.

2. The image forming apparatus according to claim 1, wherein the print-job controller measures a printing time that is a length of time elapsed since the printing operation is started, starts the printing operation when the ink temperature measured by the ink-temperature measuring unit is lower than the first reference temperature and is equal to or higher than the second reference temperature, and after the start of the printing operation, interrupts the printing operation when the printing time that is being measured reaches a predetermined length of time.

3. The image forming apparatus according to claim 2, wherein after interrupting the printing operation, the print-job controller resumes the interrupted printing operation when the ink temperature being measured by the ink-temperature measuring unit becomes equal to or higher than the first reference temperature.

4. The image forming apparatus according to claim 2, further comprising a display configured to display information that the printing operation is currently being interrupted while the printing operation is being interrupted.

5. The image forming apparatus according to claim 1, wherein the print-job controller calculates a number of sheets to be printed in the print job when the ink temperature measured by the ink-temperature measuring unit is lower than the first reference temperature and is equal to or higher than the second reference temperature, and performs the printing operation when the calculated number of sheets to be printed is equal to or smaller than a predetermined number.

6. The image forming apparatus according to claim 5, wherein when the ink temperature measured by the ink-temperature measuring unit is lower than the first reference temperature and is equal to or higher than the second reference temperature, the print-job controller performs a print job for which the printing operation is executable, prior to the other print jobs among the print jobs when receiving a plurality of print jobs.

7. The image forming apparatus according to claim 1, wherein the print-job controller calculates an image forming area in the print job when the ink temperature measured by the ink-temperature measuring unit is lower than the first reference temperature and is equal to or higher than the second reference temperature, and performs the printing operation when the calculated image forming area does not include a predetermined area located in peripheral portions of a paper sheet.

8. The image forming apparatus according to claim 7, further comprising a sheet-conveying unit configured to convey a paper sheet, wherein the ink ejector includes nozzles configured to eject ink onto the paper sheet on the basis of the driving signal outputted by the ink-ejection driver, wherein the sheet-conveying unit is placed so as to face the nozzles and includes:

an endless conveyor belt having ventilation holes therein; and a suction unit configured to generate a sucking force and adsorb the sheet to the conveyor belt with the generated sucking force via the ventilation holes of the conveyor belt, and wherein the paper sheet is conveyed by being adsorbed to the conveyor belt by the sucking force thus generated.

9. The image forming apparatus according to claim 7, wherein in the predetermined area in the peripheral portions of the paper sheet, a part located in each peripheral portion in a sheet-conveying direction has a width wider than a width of a part located in each peripheral portion in a direction crossing the sheet-conveying direction.

10. The image forming apparatus according to claim 7, wherein when the ink temperature measured by the ink-temperature measuring unit is lower than the first reference temperature and is equal to or higher than the second reference temperature, the print-job controller performs a print job for which the printing operation is executable, prior to the other print jobs among the print jobs when receiving a plurality of print jobs.

11. The image forming apparatus according to claim 1, further comprising an ink-circulation route including an ink storage disposed in a course of the route, the ink-circulation route configured to supply ink to the ink ejector and to send ink having not been ejected by the ink ejector back to the ink storage.

12. The image forming apparatus according to claim 11, wherein the ink-circulation route includes an ink heater disposed in the course of the route and configured to heat ink, and the ink heater heats the ink when the ink temperature measured by the ink-temperature measuring unit is lower than the first reference temperature, and stops heating the ink when the ink temperature becomes equal to or higher than the first reference temperature.

13. The image forming apparatus according to claim 1, wherein when receiving from a user an instruction not to perform printing with the ink of a temperature that is lower than the first reference temperature, the print-job controller does not perform the printing operation even when the ink temperature measured by the ink-temperature measuring unit is lower than the first reference temperature and is equal to or higher than the second reference temperature.

14. The image forming apparatus according to claim 1, wherein the second reference temperature is a temperature at which an appropriate amount of ink ejection for printing cannot be secured even when the voltage of the driving signal is raised.

15. A printing method comprising:

measuring an ink temperature;

receiving a print job;

outputting a driving signal on the basis of the received print job, wherein the step of outputting the driving signal including:

outputting a driving signal of a first voltage when the measured ink temperature is equal to or higher than a first reference temperature, and outputting a driving signal of a second voltage that is higher than the first voltage when the measured ink temperature is lower than the first reference temperature and is equal to or higher than a second reference temperature that is lower than the first reference temperature while a printing operation is being performed;

ejecting ink onto a paper sheet on the basis of the outputted driving signal; and performing the printing operation as long as predetermined conditions are satisfied for suppressing lowering of print quality possibly caused by ink ejection based on the driving signal of the second voltage when the measured ink temperature is lower than the first reference temperature and is equal to or higher than the second reference temperature.

* * * * *